US007255583B2

(12) United States Patent
Takagi

(10) Patent No.: US 7,255,583 B2
(45) Date of Patent: Aug. 14, 2007

(54) CONNECTION TERMINAL AND A CONNECTION TERMINAL ASSEMBLY AND METHOD FOR ASSEMBLING THE CONNECTION TERMINAL

(75) Inventor: Katsuyuki Takagi, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/491,967

(22) Filed: Jul. 25, 2006

(65) Prior Publication Data

US 2007/0032113 A1 Feb. 8, 2007

(30) Foreign Application Priority Data

Aug. 5, 2005 (JP) ..... 2005-227546

(51) Int. Cl.
*H01R 13/64* (2006.01)

(52) U.S. Cl. ..... 439/248; 439/379

(58) Field of Classification Search ..... 439/248, 439/247, 378, 379

See application file for complete search history.

(56) References Cited

U.S. PATENT DOCUMENTS 4,820,180 A * 4/1989 Mosquera et al. ..... 439/248
5,228,865 A * 7/1993 Douty et al. ..... 439/247
5,437,558 A * 8/1995 Sakuraoka et al. ..... 439/140
5,516,303 A * 5/1996 Yohn et al. ..... 439/248
5,631,632 A * 5/1997 Nakashima et al. ..... 340/611
5,769,652 A * 6/1998 Wider ..... 439/248
6,506,069 B2 * 1/2003 Babala et al. ..... 439/248
6,789,415 B1 9/2004 Kaiser et al.
2002/0098730 A1 * 7/2002 Babala et al. ..... 439/248
2005/0145035 A1 * 7/2005 Kopp ..... 73/756
2005/0202729 A1 * 9/2005 Hatanaka ..... 439/700

FOREIGN PATENT DOCUMENTS

JP 2002-542107 T 12/2002

* cited by examiner

*Primary Examiner*—Tulsidas C. Patel
*Assistant Examiner*—Vladimir Imas
(74) *Attorney, Agent, or Firm*—Foley and Lardner LLP

(57) ABSTRACT

A connection terminal includes a housing, a case fixed to the housing, a terminal stage installed inside the case and having a first terminal and a guide portion, the first terminal and the guide portion projecting parallel to each other from one end of the terminal stage in the same direction, a connected member facing the case and having a second terminal to which the first terminal is fitted and connected for establishment of electrical connection, and a recessed portion to which the guide portion is fitted. The terminal stage is movable at least in a direction orthogonal to a direction of the connection between the first and second terminals while being installed inside the case. The first and second terminals are fitted to each other after the guide portion is fitted to the recessed portion.

20 Claims, 21 Drawing Sheets

CONNECTION TERMINAL AND A CONNECTION TERMINAL ASSEMBLY AND METHOD FOR ASSEMBLING THE CONNECTION TERMINAL

BACKGROUND OF THE INVENTION

The present invention relates to a connection terminal, and more particularly to a connection terminal assembly that connects a fluid pressure sensor and a control circuit board.

In connection terminals which connect fluid pressure sensors and control circuit boards, there has been a connection terminal (a fitting-type connection terminal) that achieves an electrical contact between a male terminal and a female terminal by fitting the male terminal into the female terminal. In this connection terminal, the male terminal is an axial member formed with electric conductor such as metal, and the male terminal is inserted and fitted into the female terminal. The connection terminal, therefore, ensures electrical conductivity.

Generally, the connection terminal is not so large, therefore, an axial diameter of the male terminal tends to be small, or an axis of that tends to be thin. Further, a length of the axis of male terminal is substantially long, in order for the male terminal to be inserted and fitted into the female terminal. Because of this, the strength of the male terminal tends to become lower. Then, if positioning or locating between the male and female terminals at the insertion or the fitting is not accurate, there may arise damage to the male terminal or ill effects on the male terminal by interference between the male terminal and a housing of the female terminal. Thus, for the fitting-type connection terminal, it is necessary that the positioning between the male and female terminals takes place accurately at the insertion or the fitting. In other words, the male terminal needs inserting and fitting into the female terminal accurately.

With respect to the positioning, in a case where only one male terminal and one female terminal are connected to each other (that is, only one pair of the male and female terminals is connected to each other), the positioning thereof is easy and both terminals can be connected to each other accurately. On the other hand, there is a case where an equal numbers of a plurality of the male and female terminals are provided in an apparatus, and each of the male terminals is fixed to one housing, and each of the female terminals is fixed to the other housing, then both housings are connected to each other so as to electrically connect the male and female terminals. In this case, since each terminal is fixed to the housing, each male terminal is necessarily connected to the respective female terminals at the same time or all together. It is therefore impossible to connect the male and female terminals one by one. For this reason, each terminal has to be positioned at the housing accurately. However, in fact, it is difficult that each of the plurality of the male and female terminals is positioned or located on the housing accurately.

In particular, in a case of a fluid pressure sensor for braking device or system, it is required that a plurality of terminals should be provided and arranged on a housing formed by aluminum die casting, in order to sense fluid pressures at a plurality of measurement points set on a hydraulic circuit and to output them to a control circuit. In this case, to fix the terminals to the housing, holes (press-fitting holes) are formed on the housing, and the terminals are press-fitted into the press-fitting holes on the housing. With respect to the press-fitting hole, it is formed by drilling, and therefore its shape becomes round or circular. Because of this, there is a possibility that the terminal may rotate or turn in the press-fitting hole.

To avoid the rotation of the terminal, the terminal is fixed to the housing by caulking the press-fitting hole after the terminal is press-fitted into the press-fitting hole. However, owing to the caulking, even if the press-fitting hole is positioned on the housing accurately before the caulking, position of the terminal may become misaligned or position deviation of the terminal may occur during the caulking. To overcome this, the press-fitting hole may be formed into square shape by casting. However, in that case, there is a possibility that working fluid may leak from corners of the square press-fitting hole due to lack of sealing. Thus, the square press-fitting hole is not suitable for the fluid pressure sensor which senses the fluid pressure whose pressure is exerted inside the press-fitting hole.

Accordingly, although there is no other way than to form the press-fitting hole into round shaped hole, and to caulk the press-fitting hole after the terminal is press-fitted into the press-fitting hole, in fact, it is difficult to eliminate deviation of an actual position of the terminal from a target fixing position of the press-fitting hole when fixing the terminal to the housing, due to position error of the press-fitting hole and the above-mentioned position deviation of the terminal, occurred during the caulking.

As described above, for the terminal of the braking device and the like, in which there are the plurality of male terminals disposed on one member and the equal numbers of plurality of female terminals disposed on the other member and then the one member connects to the other member to electrically connect the male and female terminals, the positioning of the terminal is important because the plurality of the male and female terminals are connected to each other at once or all together. However, as mentioned above, it is extremely difficult that each of the plurality of male and female terminals is positioned or located accurately without misalignment or deviation of the terminal. Further, even if the positioning is made accurately, it results in deterioration in assembly performance.

For the above problems, Published Patent Application, Japanese translation of PCT international application 2002-542107 (hereinafter is referred to as "JP2002-542107") corresponding to US6789415 B1, shows a way of the electrical connection of the terminal. In the JP2002-542107, the fitting-type terminal is not used at an electrical contact portion. Electrical connection is established by means of spring contact pin, that contacts an opposed contact face by spring force (this type terminal is called a contact-type terminal). By this way of the contact (by the contact-type terminal), the accurate positioning between terminals becomes unnecessary.

SUMMARY OF THE INVENTION

In the above electrical contact of the terminal of JP2002-542107, however, the electrical contact of the terminal is established by only the spring, and the manner in which a tip of the contact pin contacts the opposed contact face or its electrical conductivity depend on only the spring force. Because of this, to ensure the electrical connection, the electrical conductivity of the contact portion needs increasing. For this reason, the contact portion or connecting portion have to be gold plated, but this leads to an increase in cost. On the other hand, when using the above-mentioned fitting-type connection terminal, the increase in cost can be avoided, but as described above, the positioning of the terminal becomes difficult and this leads to a complicated assembly process.

It is therefore an object of the present invention to provide a fitting-type connection terminal, which secures easy positioning between the terminals even though it is the fitting-type connection terminal, and avoids the increase in cost.

According to one aspect of the present invention, a connection terminal comprises: a housing; a case fixed to the housing; a terminal stage installed inside the case and having a first terminal and a guide portion, the first terminal and the guide portion projecting parallel to each other from one end of the terminal stage in the same direction; a connected member facing the case and having a second terminal to which the first terminal is fitted and connected for establishment of electrical connection, and a recessed portion to which the guide portion is fitted; the terminal stage is movable at least in a direction orthogonal to a direction of the connection between the first and second terminals while being installed inside the case; and the first and second terminals are fitted to each other after the guide portion is fitted to the recessed portion.

According to another aspect of the invention, a connection terminal assembly comprising: a first housing; a plurality of first assemblies disposed at the first housing, each of which has a case fixed to the first housing, a terminal stage installed inside the case, a first terminal, and a guide portion, the first terminal and the guide portion projecting parallel to each other from one end of the terminal stage in the same direction; a second housing including a connected member that faces the case; a plurality of second assemblies as many as the first assemblies, fixed at positions corresponding to the first assemblies on the connected member to combine with the first assemblies, each of the second assemblies having a second terminal to which the first terminal is fitted and connected for establishment of electrical connection, and a recessed portion to which the guide portion is fitted; and the terminal stage is movable inside the case at least in a direction orthogonal to a direction of the connection between the first and second terminals when combining the first and second assemblies.

According to a further aspect of the invention, a method for assembling a connection terminal comprising a first housing, a plurality of first assemblies disposed at the first housing, each of which has a case fixed to the first housing, a terminal stage installed inside the case, a first terminal, and a guide portion, the first terminal and the guide portion projecting parallel to each other from one end of the terminal stage in the same direction, a second housing including a connected member that faces the case, a plurality of second assemblies as many as the first assemblies, fixed at positions corresponding to the first assemblies on the connected member to combine with the first assemblies, each of the second assemblies having a second terminal to which the first terminal is fitted and connected for establishment of electrical connection, and a recessed portion to which the guide portion is fitted, and the terminal stage being movable inside the case at least in a direction orthogonal to a direction of the connection between the first and second terminals when combining the first and second assemblies, the method comprising: fitting the guide portion into the recessed portion; guiding the first terminal to a position corresponding to the second terminal by the fit of the guide portion into the recessed portion; and fitting the first terminal to the second terminal after guiding the first terminal.

The other objects and features of this invention will become understood from the following description with reference to the accompanying drawings.

DETAILED DESCRIPTION OF THE INVENTION

Figure 1:
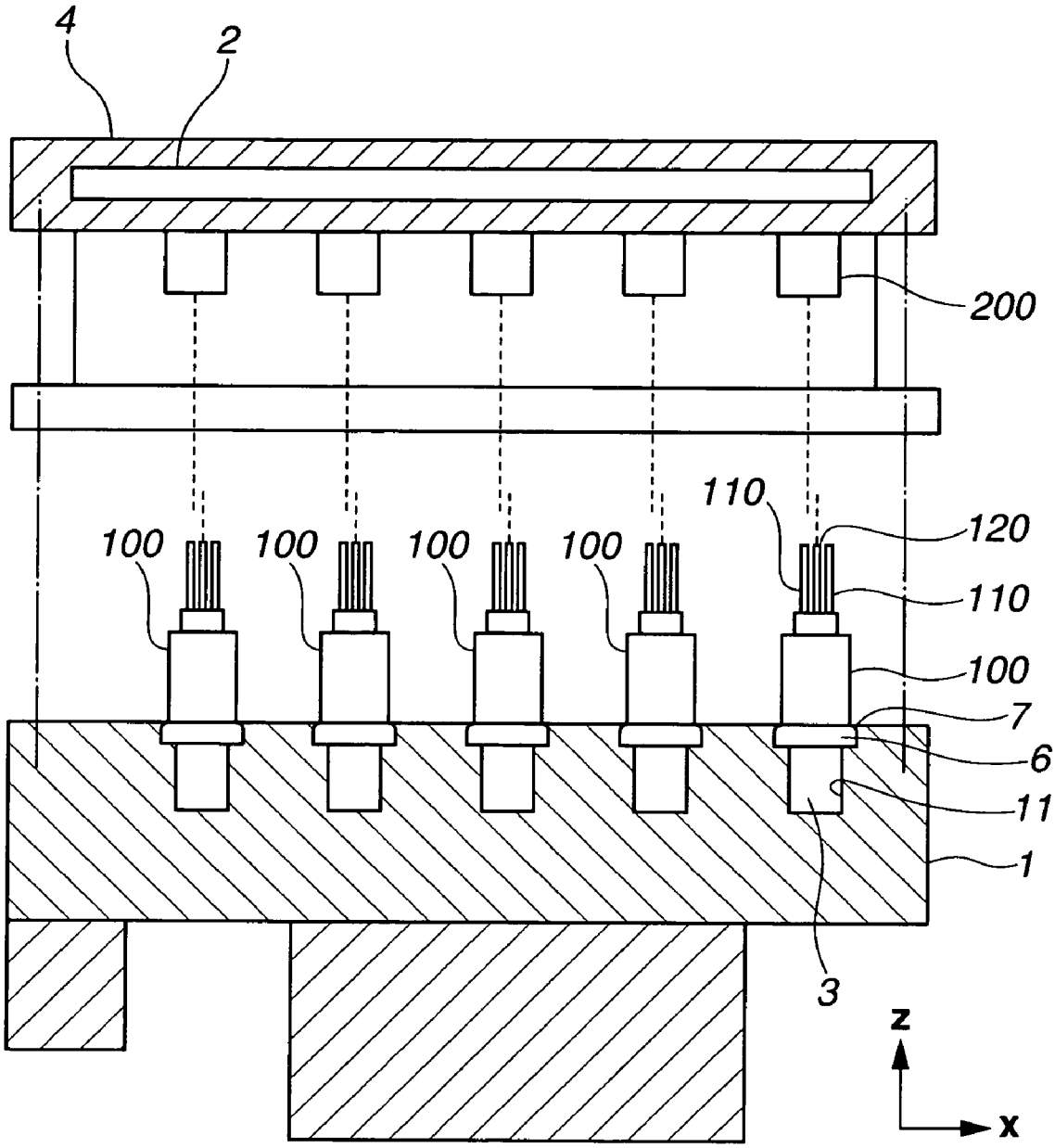
FIG. 1 is a local sectional view of a brake device using a connection terminal according to the present invention.

Embodiments of the present invention will be explained below with reference to the drawings. Firstly, an embodiment 1 will be explained with reference to FIGS. 1 to 19. FIG. 1 is a local sectional view of a brake device using a connection terminal according to the present invention. The brake device employs a hydraulic circuit housing 1 (a first housing, or simply, a housing), an electrical control unit (ECU) board 2 (a connected member) that faces hydraulic circuit housing 1, a male connector 100 (a first assembly), and a female connector 200 (a second assembly). In FIG. 1, a direction from hydraulic circuit housing 1 toward ECU board 2 (this direction is a connecting direction of a connection terminal in the present invention) is defined as z-axis, an axis orthogonal to z-axis and parallel to the drawing is defined as x-axis, and a direction normal to the drawing is defined as y-axis.

Hydraulic circuit housing 1 is formed by aluminum die casting. And a hydraulic circuit for the brake device is provided for hydraulic circuit housing 1, and further male connectors 100 are disposed on hydraulic circuit housing 1. Male connector 100 has a male terminal 110 (a first terminal). Male terminal 110 is provided such that male terminal 110 is available to move with respect to hydraulic circuit housing 1 at least in a direction parallel to x-y plane. In this embodiment 1, male terminal 110 is provided such that male terminal 110 is available to move in three dimensional directions (that is, parallel and rotational motions are available).

On hydraulic circuit housing 1, in order to fix male connector 100 to hydraulic circuit housing 1, a press-fitting hole 11 communicating with the hydraulic circuit is formed. Press-fitting hole 11 is formed by drilling, and its shape is round or circular. A lower end portion (or negative direction side end portion) in z-axis direction of male connector 100 is inserted and press-fitted into press-fitting hole 11, and then an opening of press-fitting hole 11 is caulked. Male connector 100 is, therefore, fixed to hydraulic circuit housing 1.

Figure 2:
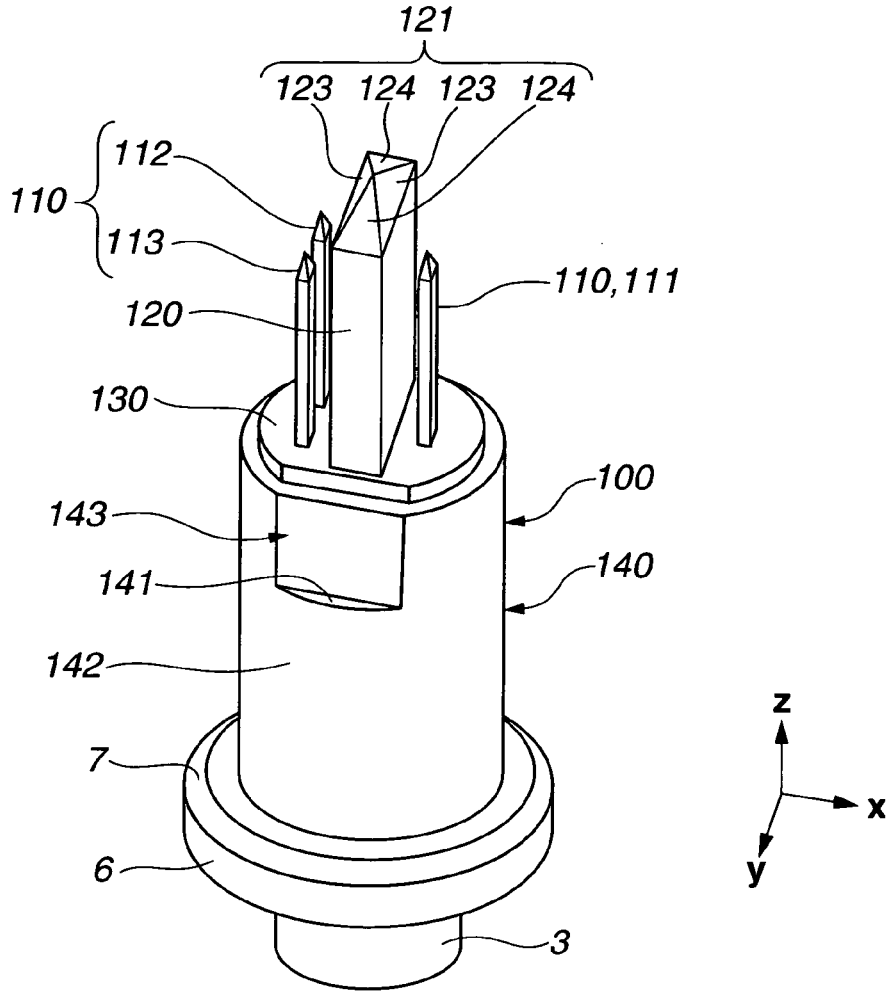
FIG. 2 is a perspective view of a male connector according to an embodiment 1.

At the lower end portion of male connector 100, a fluid pressure sensor 3 which detects or senses fluid pressure in the hydraulic circuit is provided. At an upper portion (or positive direction side portion) in z-axis direction of fluid pressure sensor 3, a flange portion 6 is formed. Further, as can be seen in FIG. 2, at an upper end portion of flange portion 6, a tapered portion 7 is formed. Tapered portion 7 is filled with a material such as aluminum of hydraulic circuit housing 1 at the caulking of press-fitting hole 11. Male connector 100 is, therefore, fixed to hydraulic circuit housing 1, as mentioned above.

As for ECU board 2, it is installed or housed in an ECU housing 4 (a second housing). And female connector 200 is provided for ECU board 2. Female connector 200 is completely fixed to ECU board 2, in contrast with male connector 100 in which male terminal 110 is available to move with respect to hydraulic circuit housing 1.

Here, male and female connectors 100 and 200 are fitting-type connectors, and male terminal 110 (the first terminal) of male connector 100 is inserted or fitted into female connector 200. In more detail about this, male terminal 110 is fitted to a female terminal 210 (a second terminal) of female connector 200, shown in FIG. 12, and therefore electrical contact or connection is established. In the present invention, since each of the male and female terminals 110, 210 is fitting-type terminal (that is, as mentioned above, male terminal 110 of male connector 100 is inserted or fitted into female connector 200 and the male terminal 110 is fitted to the female terminal 210), it is possible to ensure adequate electrical conductivity even without measures to increase the electrical conductivity.

Accordingly, each male and female terminals 110, 210 is formed by the same process as a terminal used for a normal fitting-type connector, and the measures to increase the electrical conductivity, such as a gold plating, is not particularly required. This therefore leads to cost-reduction.

Fluid pressure sensor 3 senses the fluid pressure in the hydraulic circuit, and the sensed fluid pressure (a sensed fluid pressure signal) is outputted or transmitted to ECU board 2 (control circuit of ECU board 2, or substrate of the control circuit) via male terminal 110 of male connector 100 and female terminal 210 of female connector 200. In ECU board 2, brake control is executed base on the pressure signal for optimal working fluid pressure for the brake.

With respect to female terminal 210 and female connector 200, in a case where female terminal 210 is soldered to ECU board 2, if female connector 200 should move or shift, this puts a load on a contact point of the soldered female terminal 210 to ECU board 2, and it is not preferable. In the shown embodiment, therefore, female connector 200 is fixed to ECU board 2. However, if a way of a connection or contact of female terminal 210 is different from the soldered connection and puts only small load on the contact point of the female terminal 210, it may be possible that female connector 200 is provided so that female connector 200 is available to move with respect to ECU board 2 in the three dimensional directions.

Figure 3:
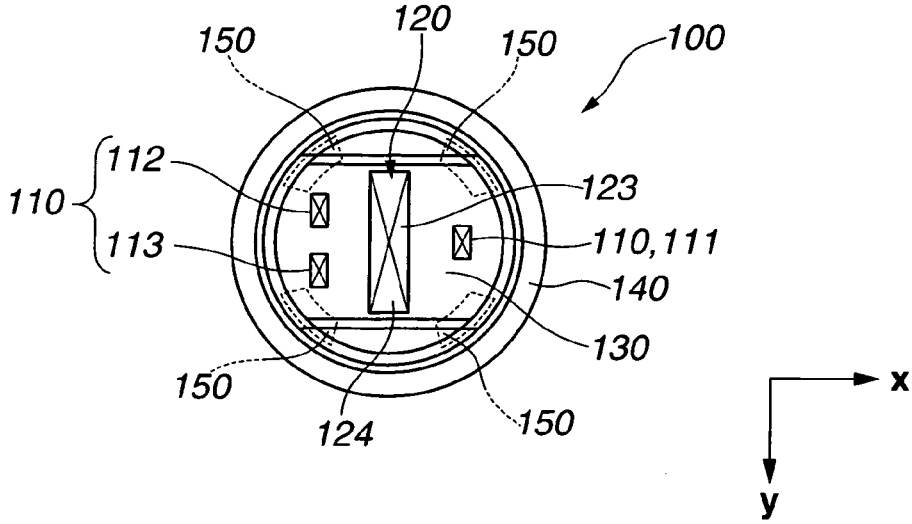
FIG. 3 is a front view of the male connector according to the embodiment 1, when viewed from positive direction of z-axis.

Next, detail of the male connector will be explained. FIG. 2 is a perspective view of male connector 100, FIG. 3 is a front view of male connector 100, when viewed from positive direction of z-axis. Male connector 100 has fluid pressure sensor 3, male terminal 110, a male terminal guide 120 (or simply, a terminal guide or guide or guide portion), a terminal stage 130, and a case 140. Case 140 is a cylindrical member, and is not available to move with respect to hydraulic circuit housing 1, i.e. case 140 is fixed to hydraulic circuit housing 1. Terminal stage 130 is installed or housed in case 140 at an upper end portion (or positive direction side end portion) in z-axis direction of case 140 with a predetermined allowable range or limit. Then, terminal stage 130 is available to move with respect to case 140 at least in the direction parallel to x-y plane (or at least in a direction orthogonal to the connecting direction of male and female terminals 110, 210). In this embodiment 1, terminal stage 130 is installed at the upper end portion of case 140 such that terminal stage 130 is available to move in the three dimensional directions (that is, parallel and rotational motions are available). On the other hand, at a lower end portion (or negative direction side end portion) in z-axis direction of case 140, cylindrical fluid pressure sensor 3 is provided. At the upper portion of fluid pressure sensor 3, as mentioned above, flange portion 6 is formed and fixed to hydraulic circuit housing 1 by the caulking.

As can be seen in FIG. 2, male terminal 110 and male terminal guide 120 protrude or project from terminal stage 130 (or one end of terminal stage 130) in positive direction of z-axis. Male terminal guide 120 is a guide member which is plate or board like in shape, and its cross-section is a rectangle whose side length in y-axis direction is longer than a side length in x-axis direction. Further, an upper (or top) end portion (or positive direction side end portion) in z-axis direction of terminal guide 120 is formed into tapered shape. In more detail, at the top end portion of terminal guide 120, a tapered portion 121 is formed (the detail of tapered portion 121 will be explained later).

Male terminal 110 is a conductive metal member same as the normal fitting-type terminal. A first male terminal 111 of male terminal 110 is disposed at a positive side in x-axis direction of terminal guide 120, while a second male terminal 112 and a third male terminal 113 of male terminal 110 are disposed at a negative side in x-axis direction of terminal guide 120. In more detail, a height in z-axis direction of male terminal 110 is set to be lower than that of terminal guide 120. By this relation of the height, at the insertion or fitting of male terminal 110, terminal guide 120 can certainly touch or contact female connector 200 prior to male terminal 110.

As can be seen in FIG. 2, and as described above, male terminal 110 and terminal guide 120 are separated from each other, and each of them projects separately from terminal stage 130. Male terminal 110 is disposed at a position where male terminal 110 can abut against terminal guide 120 by elastic deformation. If external force from positive direction of x-axis is exerted on first male terminal 111, first male terminal 111 can abut against terminal guide 120 within the elastic deformation, and plastic deformation of first male terminal 111 can be prevented. Meanwhile, as for second and third male terminals 112, 113, since they are blocked by terminal guide 120 at positive direction sides in x-axis direction of second and third male terminals 112, 113, the external force from positive direction of x-axis can not be exerted on second and third male terminals 112, 113 directly.

In like manner, if external force from negative direction of x-axis is exerted on second and third male terminals 112, 113, they can abut against terminal guide 120 within the elastic deformation, and first male terminal 111 is not affected by the external force from negative direction of x-axis. As explained above, male terminal 110 (first, second, and third male terminals 111, 112, 113) is disposed at the position where male terminal 110 can abut against terminal guide 120 by elastic deformation, and thereby protecting male terminal 110 from the external force. That is, terminal guide 120 acts as a splint that protects male terminal 110.

Figure 4:
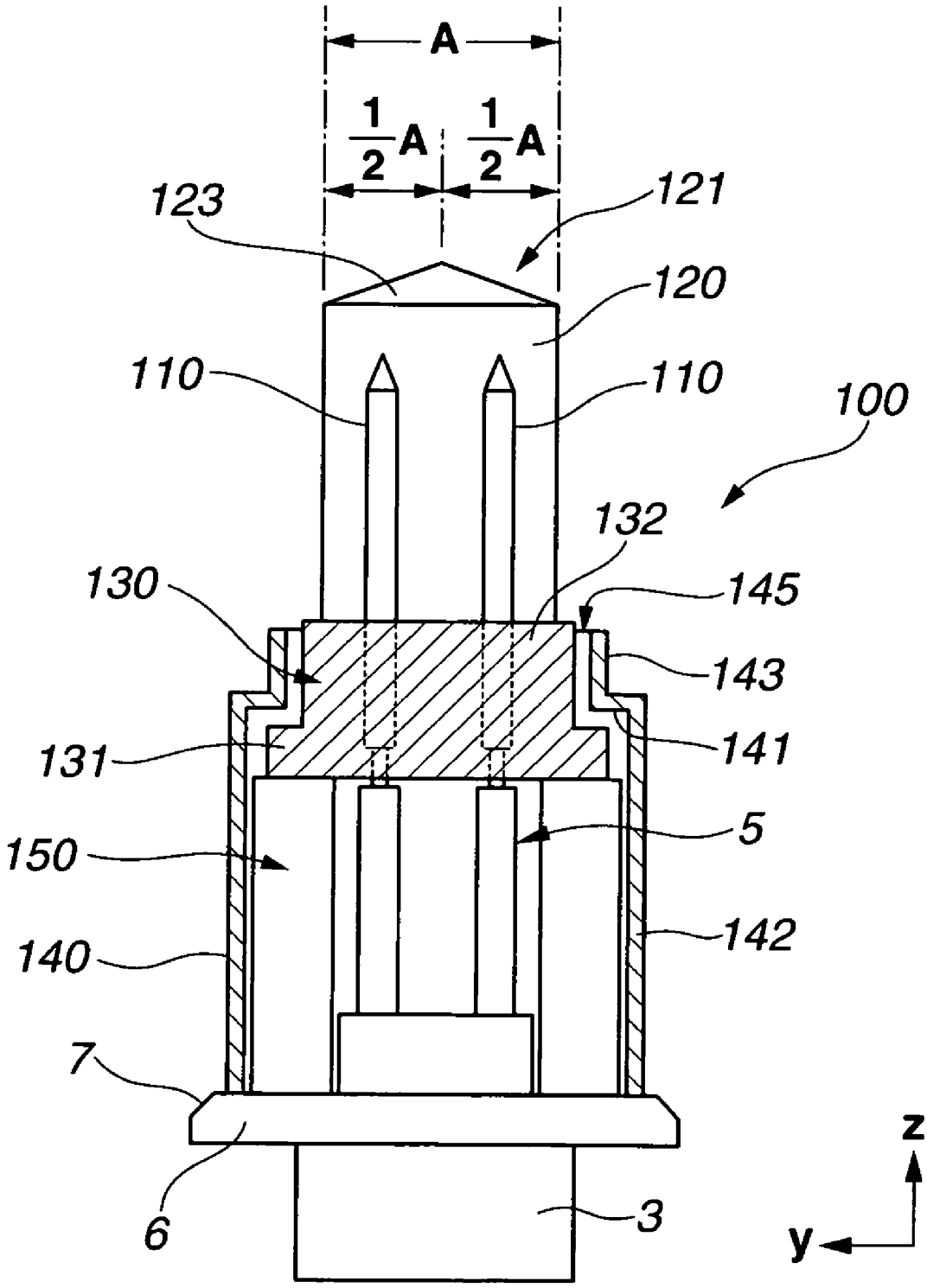
FIG. 4 is a sectional view of the male connector according to the embodiment 1, cut by y-z plane.
Figure 5:
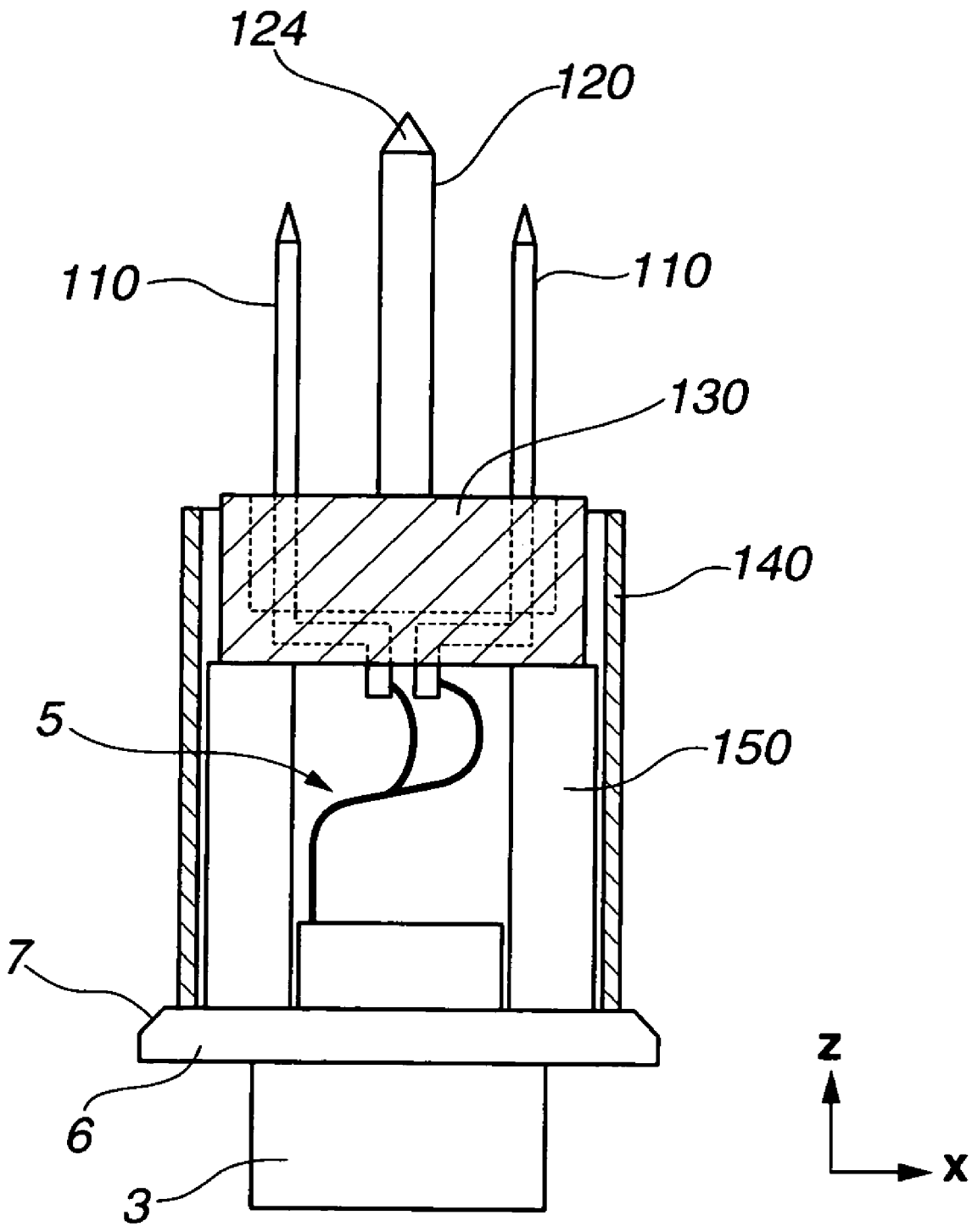
FIG. 5 is a sectional view of the male connector according to the embodiment 1, cut by x-z plane.
Figure 6:
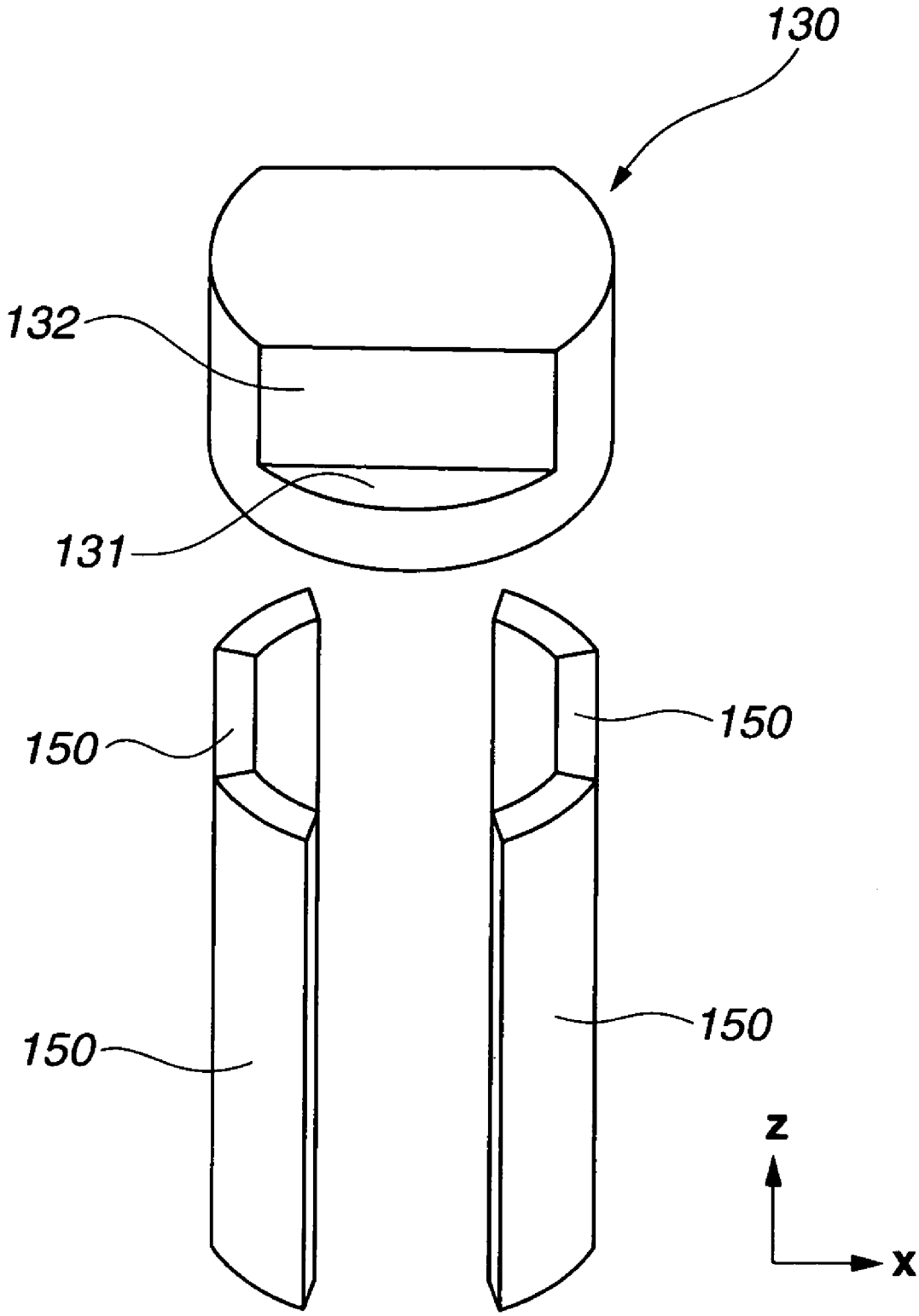
FIG. 6 is a perspective view of a seat according to the embodiment 1.

FIG. 4 is a sectional view of male connector 100, cut by y-z plane. FIG. 5 is a sectional view of male connector 100, cut by x-z plane. FIG. 6 is a perspective view of terminal stage 130 and a seat 150 that supports or holds terminal stage 130. Fluid pressure sensor 3 is provided at the opposite side to terminal stage 130 via seat 150, and fluid pressure sensor 3 and male terminal 110 are connected to each other via a harness 5. As shown in FIG. 5, harness 5 is a flexible-type harness, so as to allow terminal stage 130 to move in the three dimensional directions while maintaining the electrical connection between fluid pressure sensor 3 and male terminal 110.

Terminal stage 130 is integrally formed therewith, and has a disk portion 131 that is positioned at a lower end (or negative position side end) in z-axis direction thereof and a projecting portion 132 on disk portion 131. Projecting portion 132 is formed into substantially oval or ellipse or oblong figure which are cut off at circumferentially-opposed arcs of terminal stage 130 along z-axis direction, and projects from disk portion 131 that is disk shaped.

Case 140, which is substantially cylindrical in shape, has a step or stepped portion 141 (a limiting or limitation portion that limits movement in a terminal stage installation direction of terminal stage 130) at an upper end portion (or positive direction side end portion) in z-axis direction of case 140. Further, case 140 has a cylindrical portion 142 that is positioned below the stepped portion 141, and a hollow elongated hole portion 143 that is positioned above the stepped portion 141. Cylindrical portion 142 is substantially cylindrical in shape. As for hollow elongated hole portion 143, it is elongated hole in shape, which is cut off at circumferentially-opposed arcs of case 140 along z-axis direction in the same manner as projecting portion 132 of terminal stage 130. And an opening portion 145 of hollow elongated hole portion 143 is opened in the positive direction of z-axis as being the shape. That is to say, case 140 is formed of stepped portion 141, cylindrical portion 142, and hollow elongated hole portion 143, and opening area of opening portion 145 is defined or narrowed by stepped portion 141.

Regarding tapered portion 121 formed at the upper end portion of terminal guide 120, it is formed of an x-axis direction plane taper 123 whose triangle shaped is surface inclines in x-axis direction, and a y-axis direction plane taper 124 whose triangle shaped surface inclines in y-axis direction. As mentioned above, since cross-section of terminal guide 120 is the rectangle whose side length in y-axis direction is longer than the side length in x-axis direction, a tapered portion (or a height of triangle) of y-axis direction plane taper 124 is longer than that of x-axis direction plane taper 123. By the provision of these tapers 123, 124 in both x and y directions, even when male connector 100 deviates with respect to female connector 200 on the x-y plane at the insertion or fitting of terminal guide 120 and male terminal 110, the connection between male and female connectors 100, 200 (or the insertion of terminal guide 120 and male terminal 110 into female connector 200) can be made smoothly.

Regarding seat 150 housed beneath terminal stage 130, four seats 150 are provided to support terminal stage 130, and limit a movement in the negative direction of z-axis of terminal stage 130. In more detail, terminal stage 130 is merely laid or put or set on top ends in the positive direction of z-axis of four seats 150, and the movement in the negative direction of z-axis of terminal stage 130 is limited, but movements in other directions than the negative direction of z-axis of terminal stage 130 are not limited. In this embodiment, a number of seat 150 is four. However, if seat 150 is the one that can support terminal stage 130 and limit a downward movement in the z-axis direction of terminal stage 130, the number of seat 150 may not be limited to four.

Figure 7:
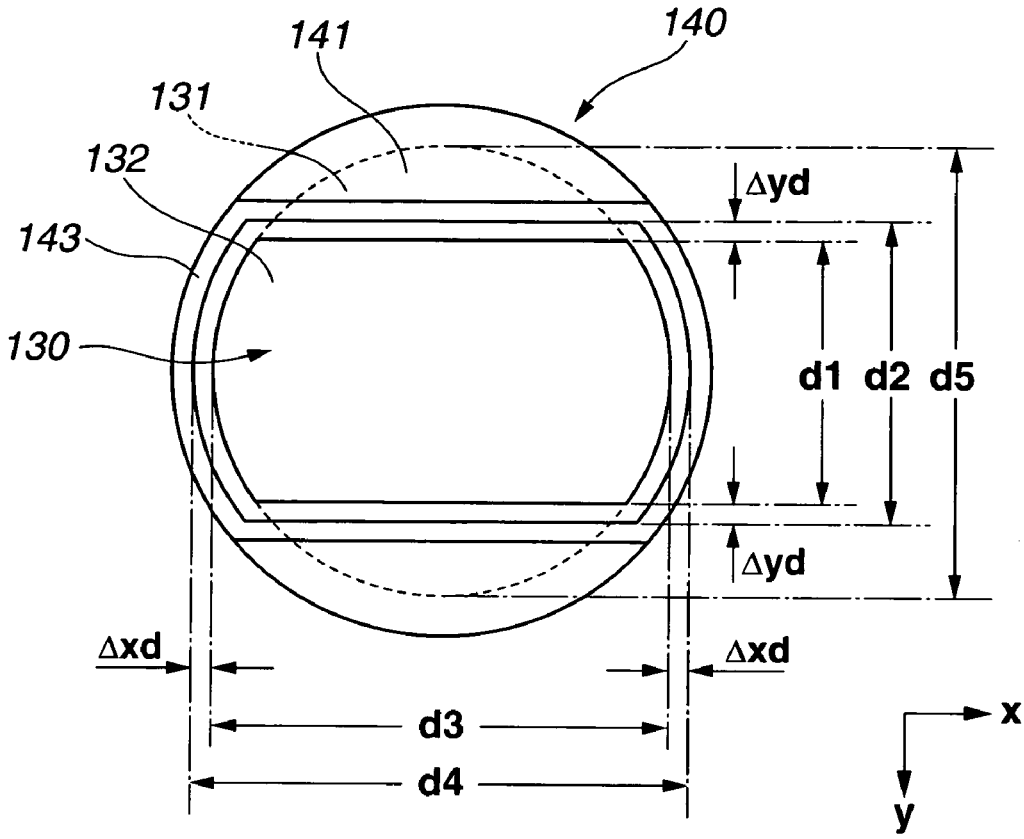
FIG. 7 is a front view of a terminal guide and the male connector according to the embodiment 1, when viewed from positive direction of z-axis.
Figure 8:
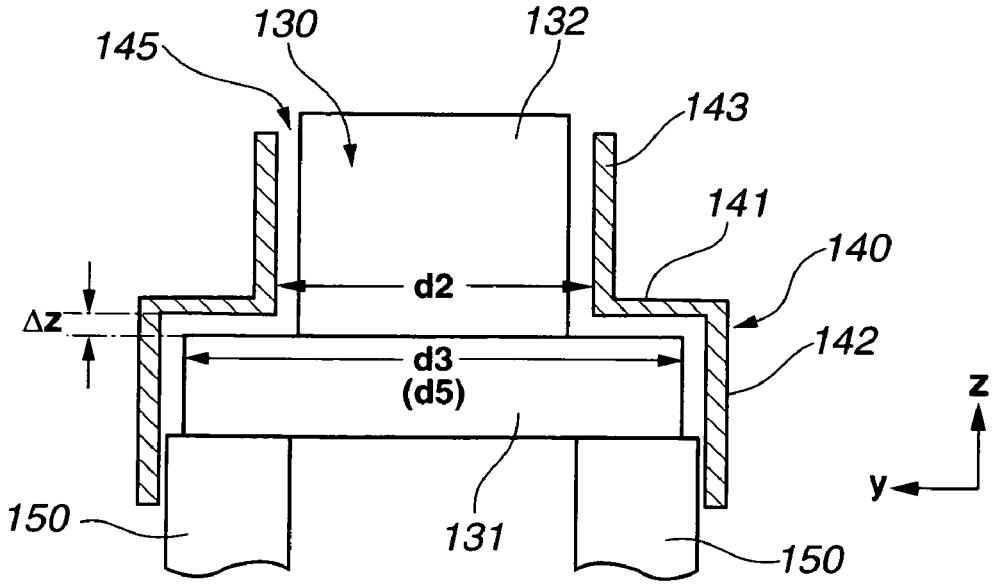
FIG. 8 is a side view of the terminal guide and the male connector according to the embodiment 1.
Figure 9:
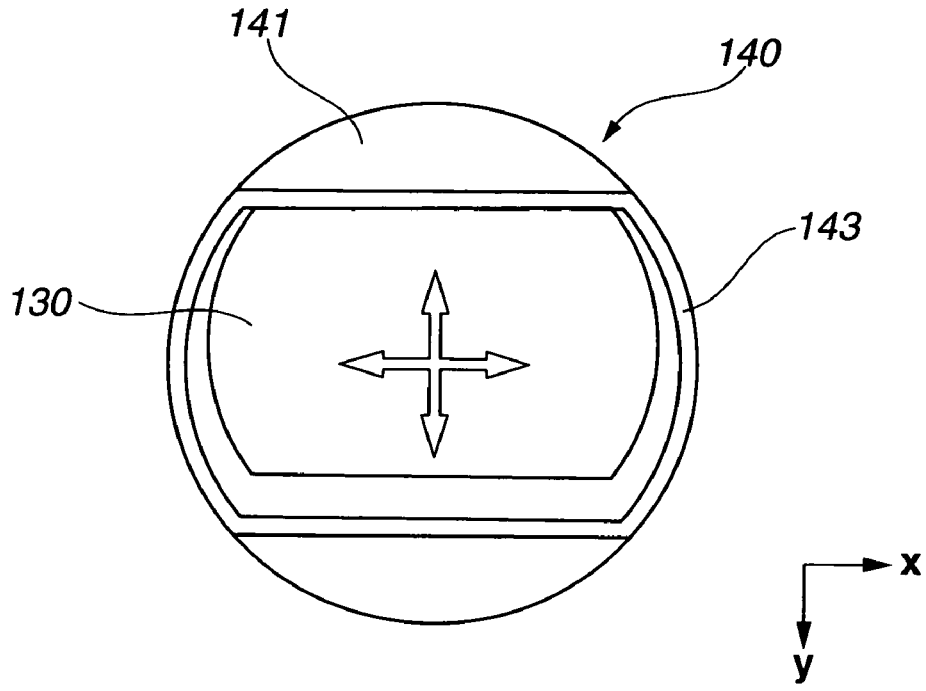
FIG. 9 is a drawing showing parallel motion of a terminal stage according to the embodiment 1 on x-y plane.
Figure 10:
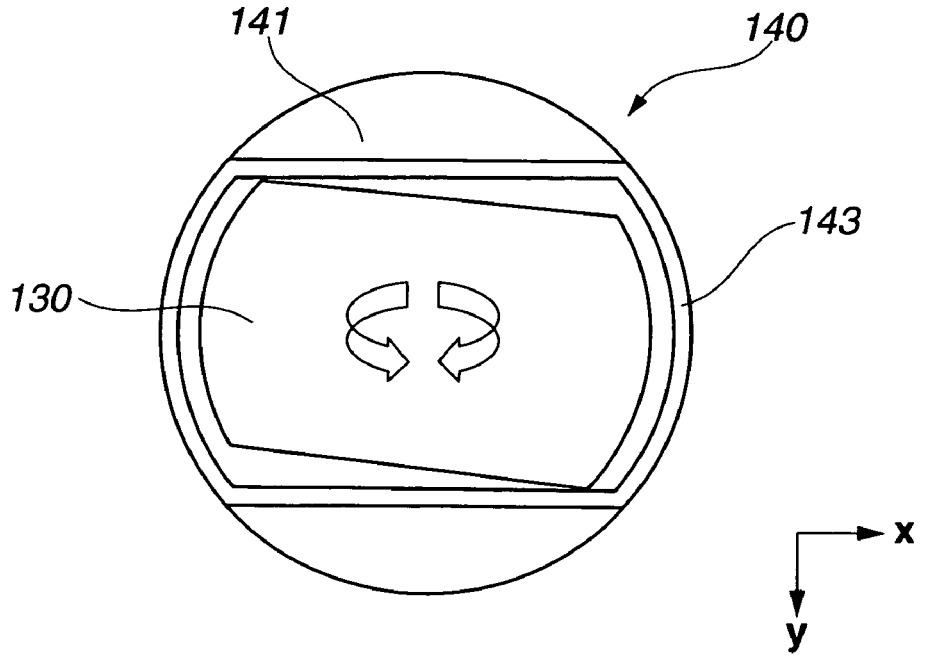
FIG. 10 is a drawing showing rotational motion of the terminal stage according to the embodiment 1 on x-y plane.
Figure 11:
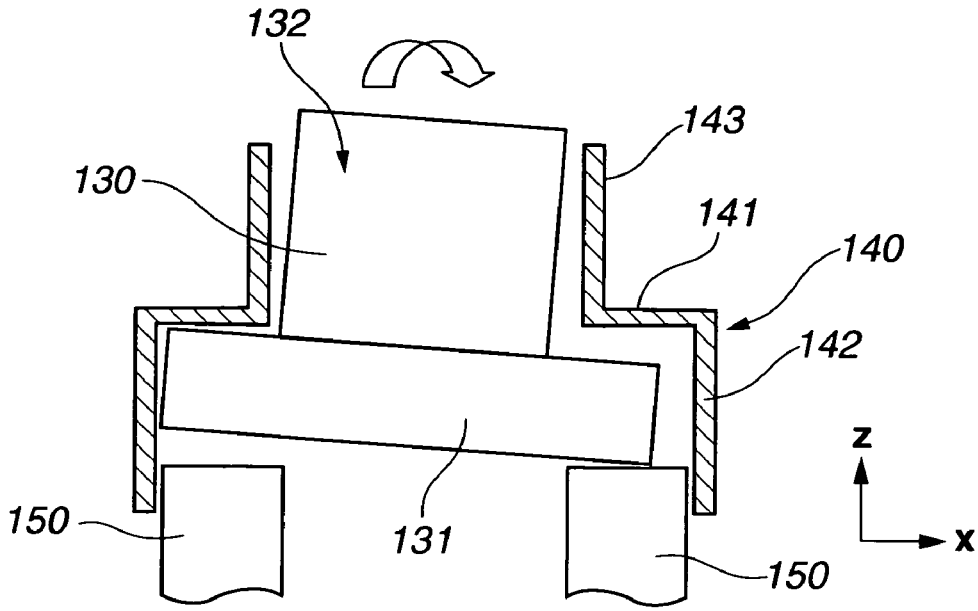
FIG. 11 is a drawing showing three-dimensional motion of the terminal stage according to the embodiment 1 in x-y-z space.

Next, sizes of terminal stage 130 and case 140 and movement of terminal stage 130 will be explained. FIG. 7 is a front view of terminal guide 120 and male connector 100, when viewed from positive direction of z-axis and omitting male terminal 110. FIG. 8 is a side view of terminal guide 120 and male connector 100. In FIG. 8, case 8 is shown as sectional view. FIG. 9 is a drawing showing parallel motion of terminal stage 130 on x-y plane. FIG. 10 is a drawing showing rotational motion of terminal stage 130 on x-y plane. FIG. 11 is a drawing showing three-dimensional motion (parallel and rotational motions) of terminal stage 130 in x-y-z space.

Firstly, with respect to size in x-y plane direction of terminal stage 130 and case 140, a diameter of minor (or shorter) axis of projecting portion 132 is denoted by "d1", a diameter of major (or longer) axis of projecting portion 132 is denoted by "d3". On the other hand, a diameter of minor axis of an inside of hollow elongated hole portion 143 is denoted by "d2", a diameter of major axis of the inside of hollow elongated hole portion 143 is denoted by "d4". Here, relationships between the above sizes are d1<d2, d3<d4, and d2<d3. By the relationships of d1<d2, d3<d4, clearances or gaps Δxd, Δyd in x-axis and y-axis directions between projecting portion 132 of terminal stage 130 and hollow elongated hole portion 143 of case 140 are formed. And thus, as shown in FIGS. 9, 10, projecting portion 132 can move in the direction parallel to x-y plane or rotate on x-y plane, within a predetermined allowable range while being inserted into hollow elongated hole portion 143. However, regarding the rotational motion or movement of projecting portion 132, as shown in FIG. 10, it is limited to within a predetermined rotational angle or predetermined allowable range. That is, hollow elongated hole portion 143 acts as a rotation stopper portion that limits the rotation and also the movement in the direction parallel to x-y plane (or on the plane normal to the connecting direction) of terminal stage 130 to within the predetermined allowable range.

Secondly, as regards z-axis direction and three dimensional directions, as shown in FIG. 8, a diameter "d3" of disk portion 131 of terminal stage 130 is set to be larger than the diameter "d2" of minor axis of the inside of hollow elongated hole portion 143. Further, terminal stage 130 is set on seat 150 inside case 140 such that a clearance or gap Δz between disk portion 131 and stepped portion 141 of case 140 is created. Terminal stage 130 is therefore able to move in z-axis direction within the allowance Δz. However, because of d3>d2, disk portion 131 is blocked by stepped portion 141, and thus, the movement in the positive direction of z-axis of terminal stage 130 is limited to within the allowance Δz (or within predetermined allowable limits). On the other hand, since terminal stage 130 is supported by stick shaped seat 150 inside case 140, terminal stage 130 can not move in the negative direction of z-axis. Accordingly, in addition to the movement on x-y plane as described above, terminal stage 130 can move in the positive direction of z-axis. That is, terminal stage 130 can move in the three dimensional directions except the negative direction of z-axis within the predetermined allowable range. In other words, terminal stage 130 is installed with the predetermined allowable limits so that parallel and rotational motions in the three dimensional directions of terminal stage 130 are available.

Figure 12:
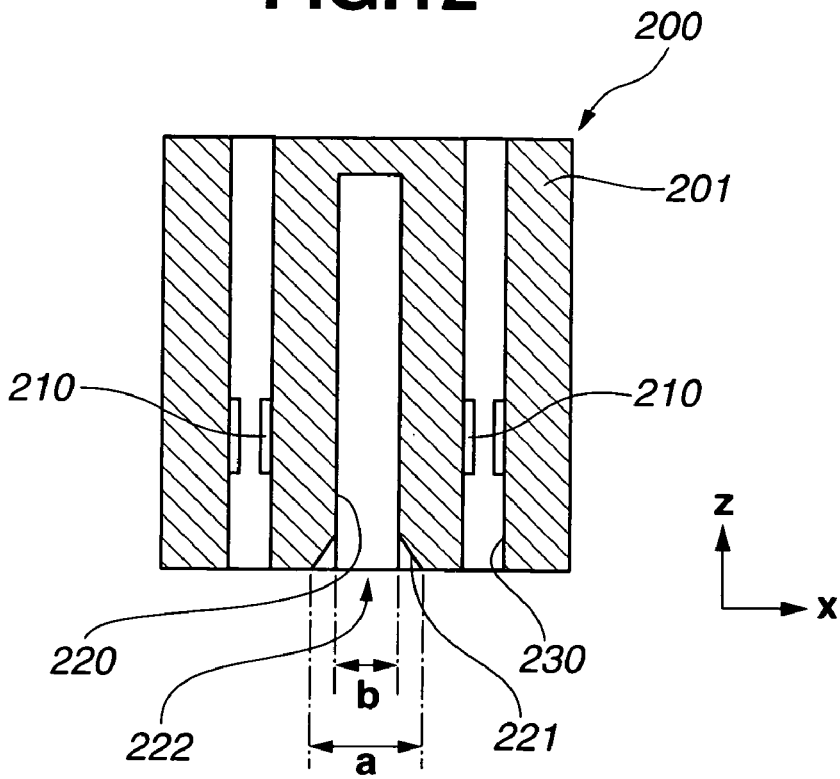
FIG. 12 is a sectional view of a female connector according to the embodiment 1.

Next, detail of the female connector will be explained. FIG. 12 is a sectional view of female connector 200. Female connector 200 has a terminal housing 201. Terminal housing 201 is formed with a guide insertion hole 220 (a recessed portion) and a terminal insertion hole 230 in z-axis direction. Guide insertion hole 220 and terminal insertion hole 230 are respectively formed into sizes capable of receiving terminal guide 120 and male terminal 110. Further, an opening portion (called an opening portion 222) in the negative direction of z-axis of guide insertion hole 220 is formed into tapered shape. In more detail, at opening portion 222 of guide insertion hole 220, a tapered surface or face 221 is formed. Then, opening portion 222 of guide insertion hole 220 is widely opened by tapered surface 221. And, as can be seen in FIG. 12, a width "a" in x-axis direction of opening portion 222 is set to be wider than a width "b" of terminal guide 120 (namely, a>b). As for terminal insertion hole 230, female terminal 210 is provided inside terminal insertion hole 230.

Figure 13:
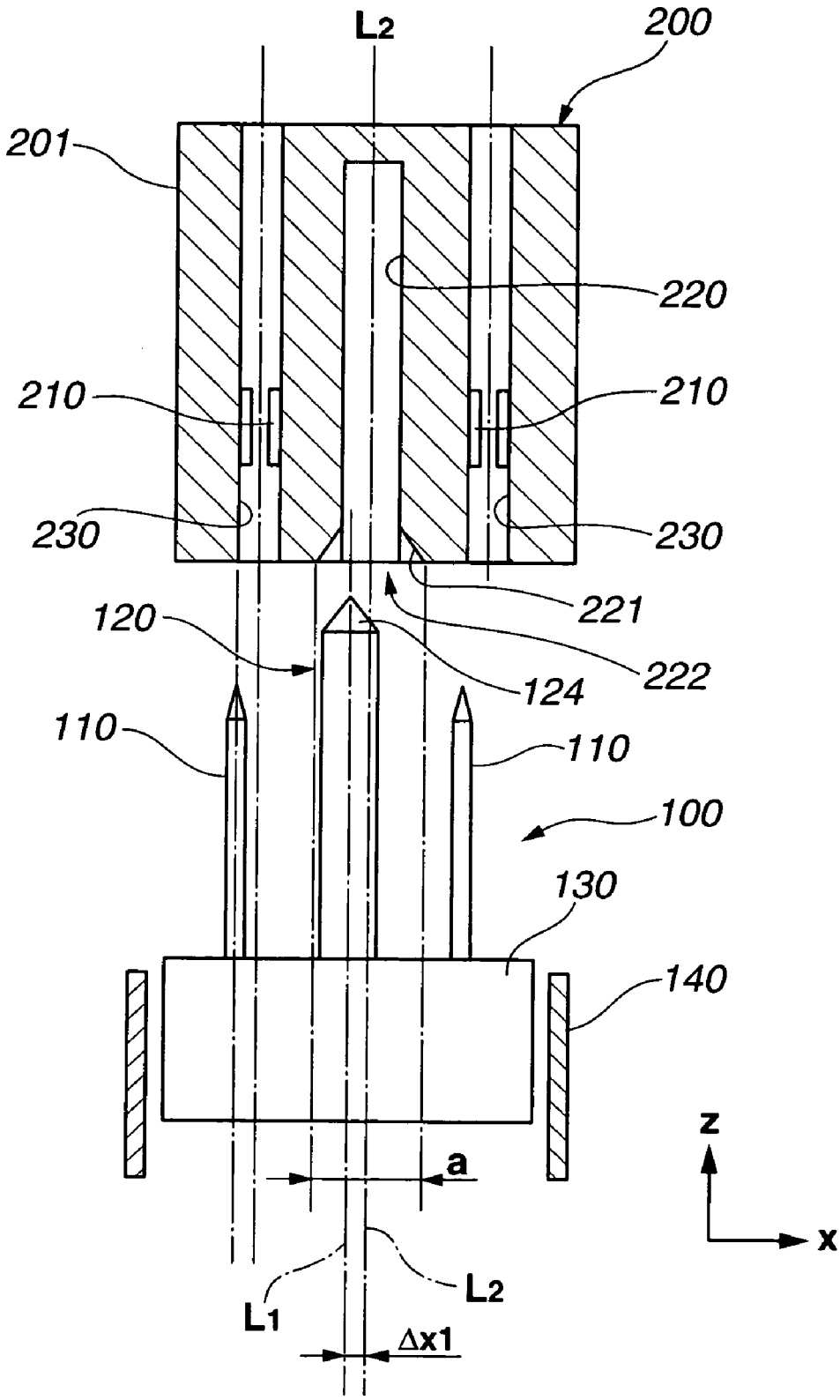
FIG. 13 is a sectional view of the male and female connectors according to the embodiment 1 before connection of the connectors.
Figure 14:
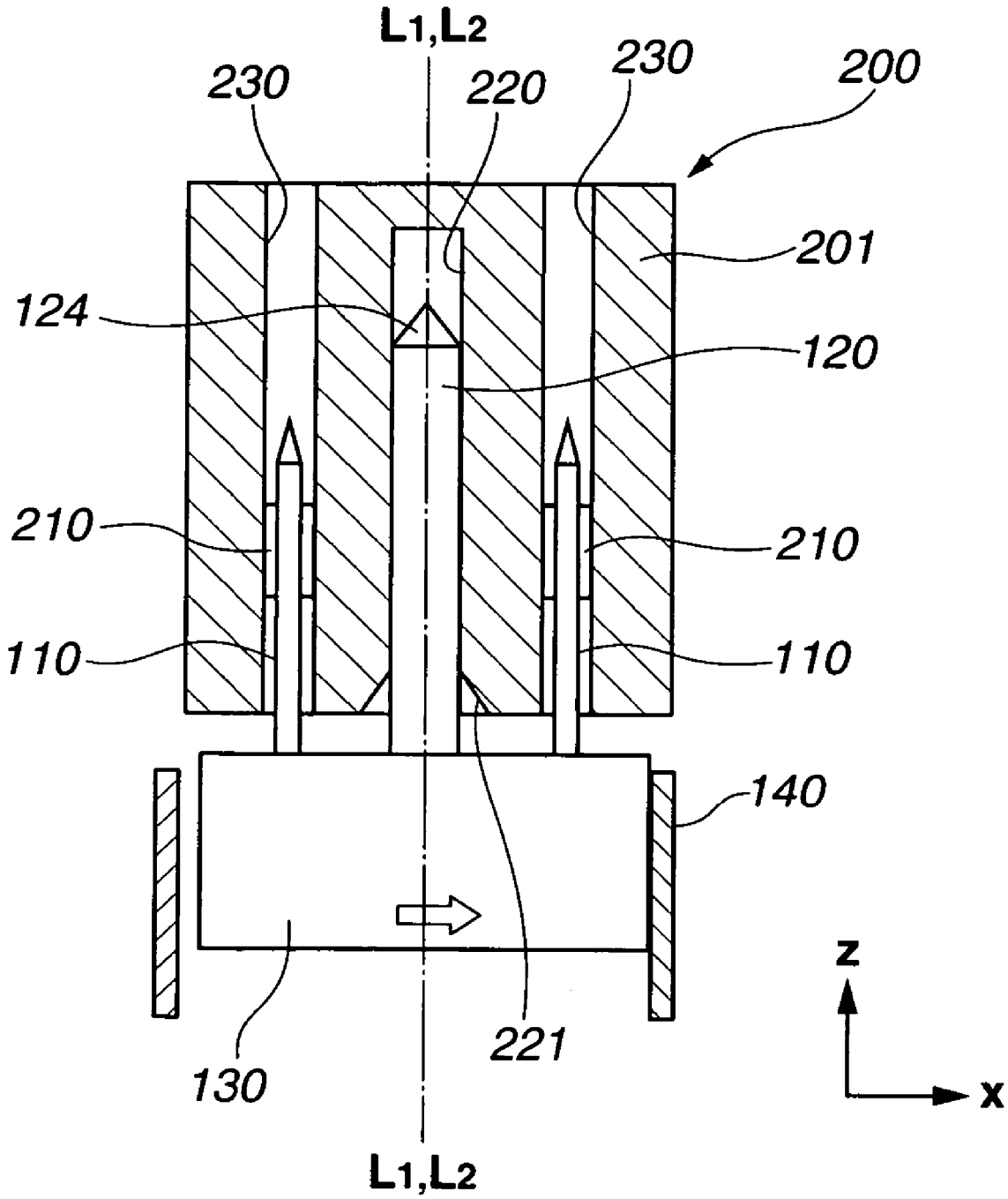
FIG. 14 is a sectional view of the male and female connectors according to the embodiment 1 after connection of the connectors.

Next, the connection of the connector will be explained below. FIGS. 13 and 14 are sectional views of male and female connectors 100, 200, before and after the connection. In both FIGS. 13, 14, male connector 100 is shown as side view. As described above, terminal stage 130 of male connector 100 is set such that terminal stage 130 can move with respect to case 140 in three dimensional directions within the predetermined allowable limits (namely, that the three-dimensional motions are available). In the shown embodiment, before the connection as shown in FIG. 13, in a case where a central axis "L1" of terminal guide 120 of male connector 100 deviates with respect to a central axis "L2" of guide insertion hole 220 of female connector 200 in x-axis direction, if its deviation amount (or width) Δx1 is within the width "a" of opening portion 222 of guide insertion hole 220, x-axis direction plane taper 123 of tapered portion 121 formed at the upper end portion of terminal guide 120 can touch or contact tapered surface 221 of guide insertion hole 220. At this time, since terminal stage 130 of male connector 100 can move with respect to case 140 in three dimensional directions, terminal guide 120 can be guided into guide insertion hole 220 or to a center of guide insertion hole 220 (male terminal 110 is also guided to a position corresponding to female terminal 210 at the same time). That is, the central axis "L1" of terminal guide 120 fits the central axis "L2" of guide insertion hole 220 by tapered surface 221 and x-axis direction plane taper 123 of terminal guide 120. Then, terminal guide 120 can be inserted into guide insertion hole 220 smoothly. In this way, the positioning between male terminal 110 and female connector 200 is made accurately, and therefore, as shown in FIG. 14, male and female terminals 110, 210 are fitted to each other.

In this embodiment, also for deviation in y-axis direction of terminal guide 120, by y-axis direction plane taper 124 of tapered portion 121, terminal guide 120 can be fitted or inserted into guide insertion hole 220 smoothly even when male connector 100 deviates with respect to female connector 200 in y-axis direction. In more detail about the deviation in y-axis direction, as previously described, the cross-section of terminal guide 120 is the rectangle and the tapered portion in y-axis direction of y-axis direction plane taper 124 is longer than the tapered portion in x-axis direction of x-axis direction plane taper 123. Because of this, in a case where male connector 100 deviates with respect to female connector 200 in y-axis direction by Δy, if its deviation amount Δy is within a half-width "A" of long side of terminal guide 120, namely within ½A (see FIG. 4), terminal guide 120 can be guided into guide insertion hole 220 by y-axis direction plane taper 124. Accordingly, with regard to the deviation in y-axis direction of terminal guide 120, the deviation is corrected by y-axis direction plane taper 124 of terminal guide 120 even without provision of a tapered surface in y-axis direction at opening portion 222 of guide insertion hole 220, as opposed to the case of deviation in x-axis direction. And then, male and female connectors 100, 200 can be smoothly connected to each other.

In addition, even in a case where terminal guide 120 deviates with respect to guide insertion hole 220 in a rotational direction on x-y plane, the rotational deviation is corrected by both x-axis and y-axis direction plane tapers 123, 124. That is, terminal stage 130, which is capable of three-dimensional motions, rotates on x-y plane as x-axis and y-axis direction plane tapers 123, 124 are guided, and therefore terminal guide 120 can be smoothly inserted or fitted into guide insertion hole 220.

Figure 15A:
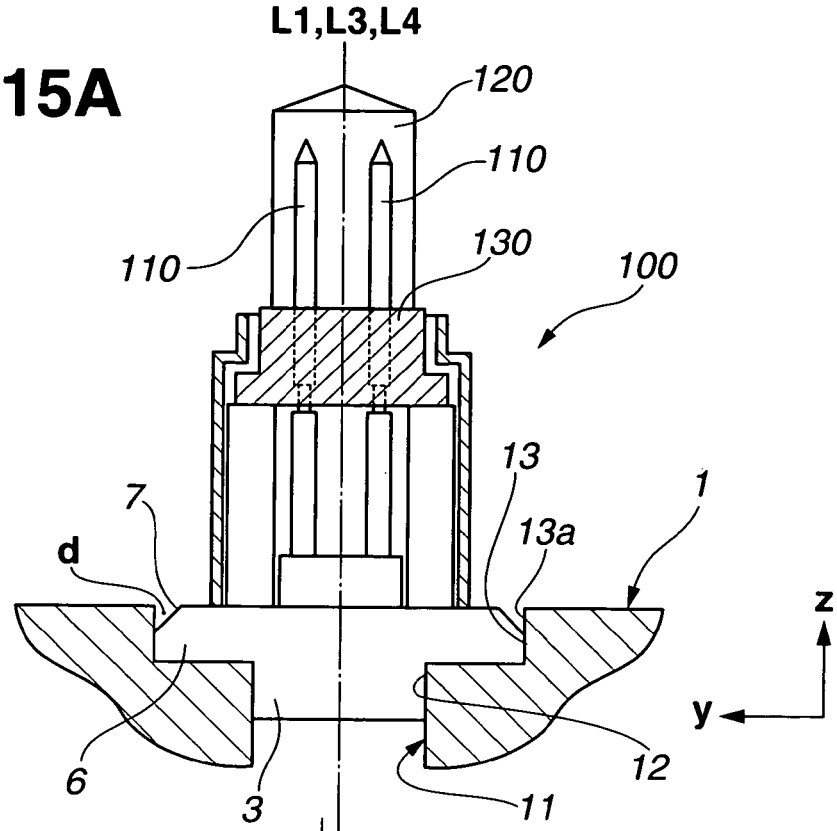
FIGS. 15A and 15B are drawings showing a caulking process of the male connector.
Figure 15B:
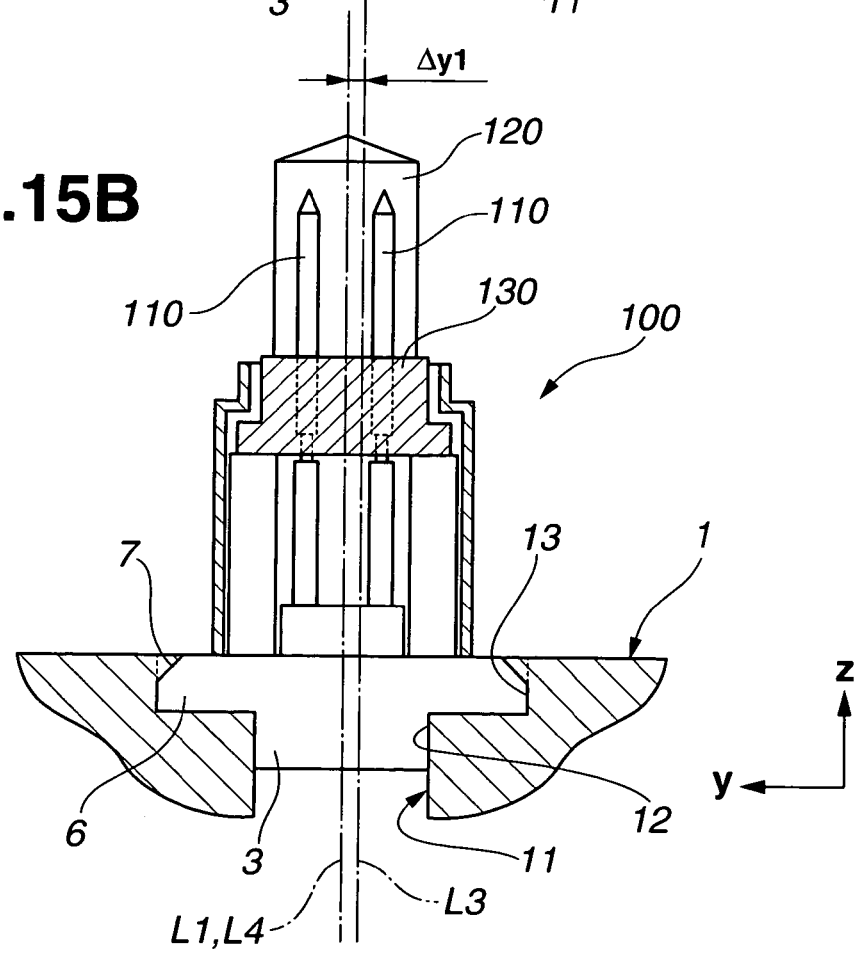

Next, the caulking for fixing male connector 100 to hydraulic circuit housing 1 will be explained. FIG. 15 is a drawing showing a caulking process of male connector 100. FIGS. 15A and 15B show the drawings before and after the caulking. Here, "L1" denotes a central axis of male connector 100, "L3" denotes a target fixing position of the central axis of male connector 100, "L4" denotes an actual position of central axis of male connector 100 after the caulking. Before the caulking, the central axis "L1" fits the target fixing position "L3", the actual position "L4" also fits the target fixing position "L3".

As previously described, press-fitting hole 11 is formed on hydraulic circuit housing 1 by drilling, and communicates with the hydraulic circuit. Further, this round shaped press-fitting hole 11 is formed of a first stepped portion 12 into which fluid pressure sensor 3 is press-fitted and a second stepped portion 13 into which flange portion 6 is press-fitted. Before the caulking, because tapered portion 7 is formed at the upper end portion of flange portion 6, a gap or space "d" is formed between flange portion 6 and an opening portion (called an opening portion 13*a*) of second stepped portion 13.

In the caulking process, opening portion 13*a* of second stepped portion 13 is plastically deformed by the caulking, and the material such as aluminum of hydraulic circuit housing 1 fills the gap "d". Then, a periphery or circumference of flange portion 6 is fixed, and its rotation in press-fitting hole 11 is certainly eliminated. Accordingly, male connector 100 is fixed to hydraulic circuit housing 1 without the rotation of male connector 100, using the round shaped press-fitting hole which is more effective than a square shaped press-fitting hole in avoiding leak of working fluid.

However, during the caulking process, there is a possibility that male connector 100 will move or shift in radial direction due to the plastic deformation of opening portion 13*a* of second stepped portion 13 by the caulking. FIG. 15 is one example showing the movement of shift of male connector 100 after the caulking. FIG. 15 shows a case of movement in the negative direction of y-axis. Central axis "L1" of male connector 100 shifts in the radial direction after the caulking, as a result, the actual position "L4" of central axis of male connector 100 deviates from the target fixing position "L3" by Δy1. In this way, in fast, it is difficult to eliminate the deviation between the target fixing position "L3" and the actual position "L4" when fixing male connector 100 to hydraulic circuit housing 1.

In the present invention, as shown in FIGS. 12 to 14, if the deviation Δy1 of male connector 100, occurred during the caulking, is within the half-width "A" of long side of terminal guide 120, namely within ½A (see FIG. 4), since terminal stage 130 is able to move, terminal guide 120 is guided into guide insertion hole 220 by y-axis direction plane taper 124. That is, the deviation of male connector 100, occurred during the caulking, is absorbed, and thereby achieving accurate positioning.

Figure 16:
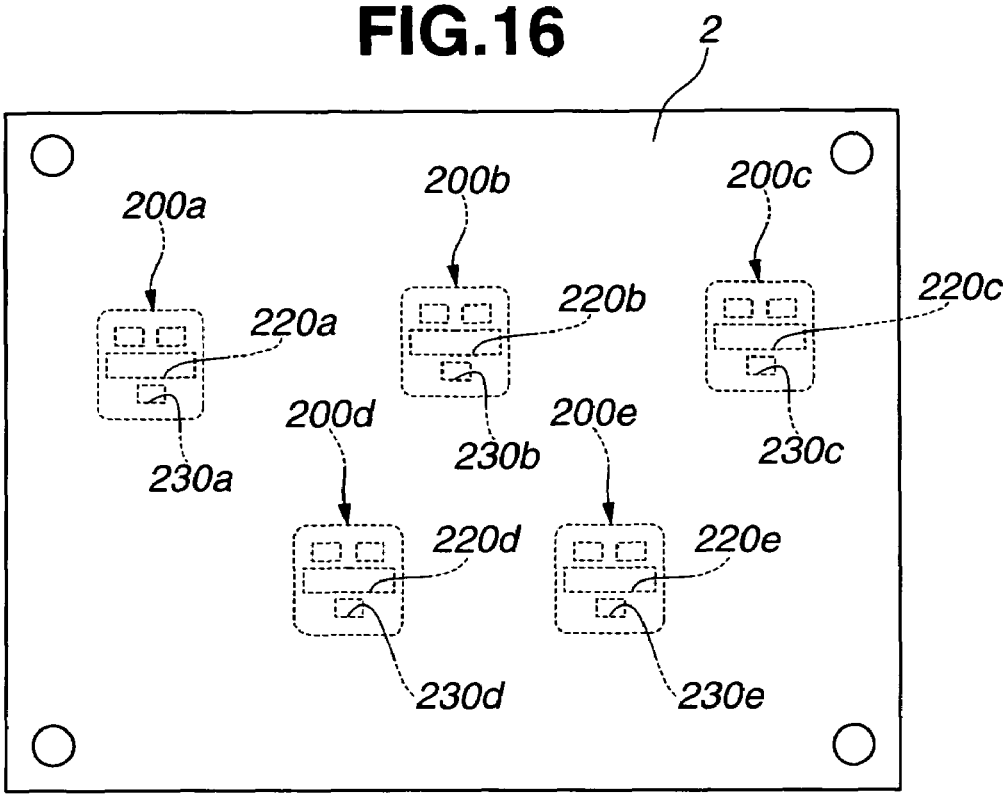
FIG. 16 is a front view of an ECU board according to the embodiment 1, when viewed from positive direction of z-axis, before connecting the connectors.
Figure 17:
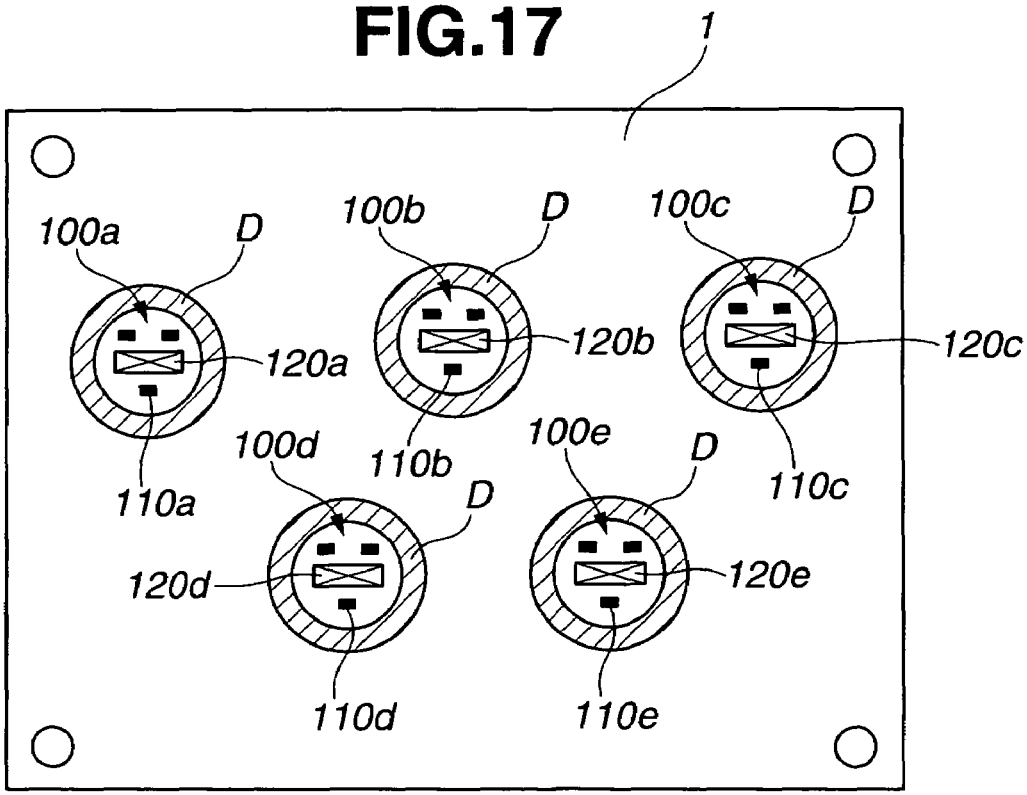
FIG. 17 is a front view of a hydraulic circuit housing according to the embodiment 1, when viewed from positive direction of z-axis, before connection of the male connector.
Figure 18:
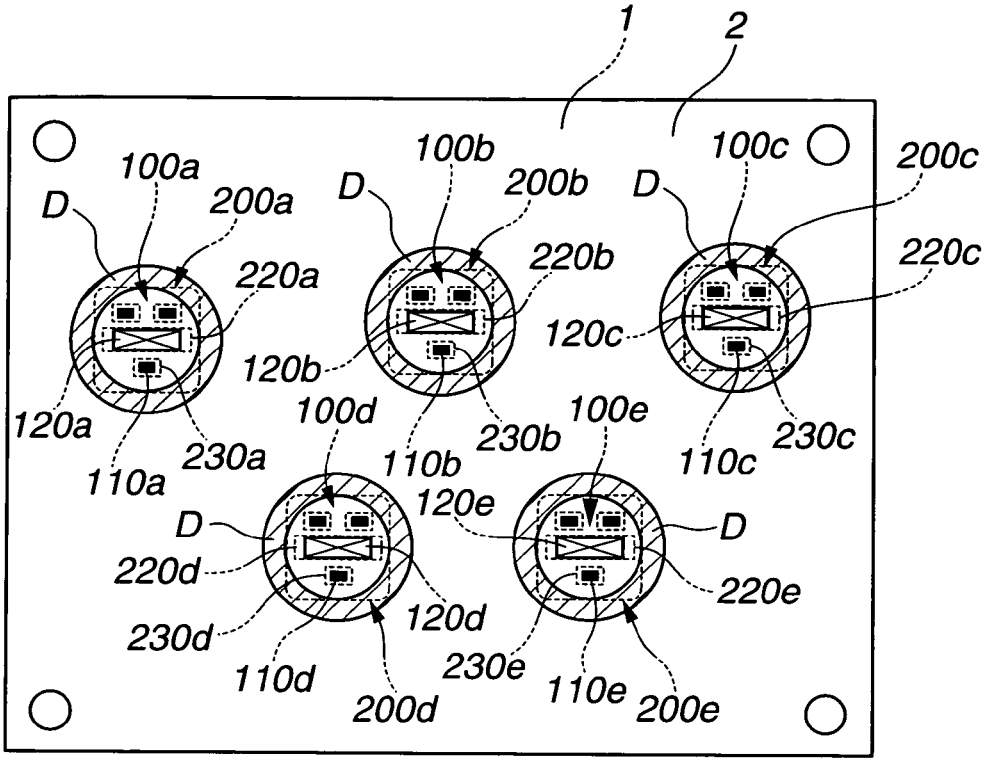
FIG. 18 is a front view of the ECU board according to the embodiment 1, when viewed from negative direction of z-axis, after connecting the connectors.

Next, correction of deviation of each pair of male and female connectors at connection of a plurality of connectors all together will be explained. FIG. 16 is a front view of ECU board 2, when viewed from positive direction of z-axis, before connecting male connector 100. FIG. 17 is a front view of hydraulic circuit housing 1, when viewed from positive direction of z-axis. FIG. 18 is a front view of ECU board 2, when viewed from negative direction of z-axis, after connecting male connector 100. In FIGS. 17 and 18, diagonally shaded areas show movable areas "D" where terminal stage 130 of male connector 100 can move. Further, for the explanation, harness 5 etc. are omitted.

On a lower surface (or negative direction side surface) in z-axis direction of ECU housing 4, a plurality of female connectors 200*a*~200*e* are provided. Further, female terminals 210*a*~210*e* provided inside female connectors 200*a*~200*e* are respectively electrically connected to ECU board 2 installed in ECU housing 4, by soldered connection. On the other hand, on an upper surface (or positive direction side surface) in z-axis direction of hydraulic circuit housing 1, the equal numbers of plurality of male connectors 100*a*~100*e* (a plurality of male connectors 100*a*~100*e* as many as female connectors 200*a*~200*e*) are provided.

Each of the male connectors 100*a*~100*e* and female connectors 200*a*~200*e* is disposed at respective corresponding positions where each pair of the male and female connectors can be connected. In more detail, each male connectors 100*a*~100*e* and female connectors 200*a*~200*e* is disposed so that all the male and female connectors can be fitted and connected to each other by bringing hydraulic circuit housing 1 close to ECU housing 4. Hereinafter, male connectors 100*a*~100*e* and female connectors 200*a*~200*e* are collectively called male connector 100 and female connector 200.

In assemblies, there occur assembly error or misalignment and deviation. That is, during a process in which female connector 200 is fixed to ECU housing 4, and during a process in which male connector 100 is fixed to hydraulic circuit housing 1, assembly errors or misalignments occur. In addition to the assembly errors, each male and female connectors 100, 200 itself has error in size or shape or the like. Because of this, axis positions of male and female connectors 100, 200 in x-y-z coordinate system do not completely fit each other, and this results in a slight deviation in three dimensional directions.

With respect to the assembly of hydraulic circuit housing 1 and ECU housing 4, if central axes "L1, L2" of male and female connectors 100, 200 deviate from each other, or if terminal guide 120 of male connector 100 deviates with respect to guide insertion hole 220 of female connector 200 in the rotational direction on x-y plane, the connection between male and female connectors 100, 200 is impossible. However, as described above, stage 130 of male connector 100 can move with respect to case 140 in three dimensional directions, and also can move with respect to hydraulic circuit housing 1 in three dimensional directions within the movable area "D" (because case 140 is fixed to hydraulic circuit housing 1). Consequently, in the case where the plurality of male and female connectors 100, 200 are provided, even if each connecting position between the pair of male and female connectors 100, 200 deviates between the pair of male and female connectors 100, 200 before the connection, male terminal 110 of male connector 100 and terminal guide 120 move and central axes "L1, L2" of male and female connectors 100, 200 can fit each other.

Accordingly, even if an amount and direction of deviation between each pair of male and female connectors 100, 200 are different from the other pair of male and female connectors 100, 200, as described above, terminal guide 120 can be inserted into guide insertion hole 220 of female connector 200 smoothly. And also, male terminal 110 can be inserted into terminal insertion hole 230, then male terminal 110 can be fitted to female terminal 210 smoothly.

As explained above, in the embodiment 1, terminal stage 130 of male connector 100 is set such that terminal stage 130 can move with respect to case 140 in three dimensional directions within the predetermined allowable limits (namely, that the parallel and rotational motions are available). Accordingly, by setting the predetermined allowance in view of the assembly errors or misalignments and the errors in size or shape or the like which each member itself has, even if the central axes "L1, L2" of male and female connectors 100, 200 deviate from each other due to the errors etc, terminal stage 130 is moved within the movable area "D", and then the deviation can be corrected. By this way, it is possible that all pair of male and female connectors 100, 200 disposed at hydraulic circuit housing 1 and ECU housing 4 (ECU board 2) are fitted or connected to each other at once. And then, a connection terminal assembly is formed by combining hydraulic circuit housing 1 and ECU housing 4 (or the plurality of the first and second assemblies, namely, male and female connectors 100, 200).

With respect to female terminal 210 and female connector 200, in the case where female terminal 210 is soldered to ECU board 2, as previously described, if female connector 200 should move or shift, this puts the load on the contact point of the soldered female terminal 210 to ECU board 2, and it is not preferable. Female connector 200 is, therefore, fixed to ECU board 2 in this embodiment. However, providing that the way of connection or contact of female terminal 210 is different from the soldered connection and puts only small load on the contact point of the female terminal 210, it may be possible that female connector 200 is provided so that female connector 200 is available to move with respect to ECU board 2 in the three dimensional directions. For instance, it is that female terminal 210 is connected to ECU board 2 via female connector 200 that is movable by flexible-type harness.

Figure 19:
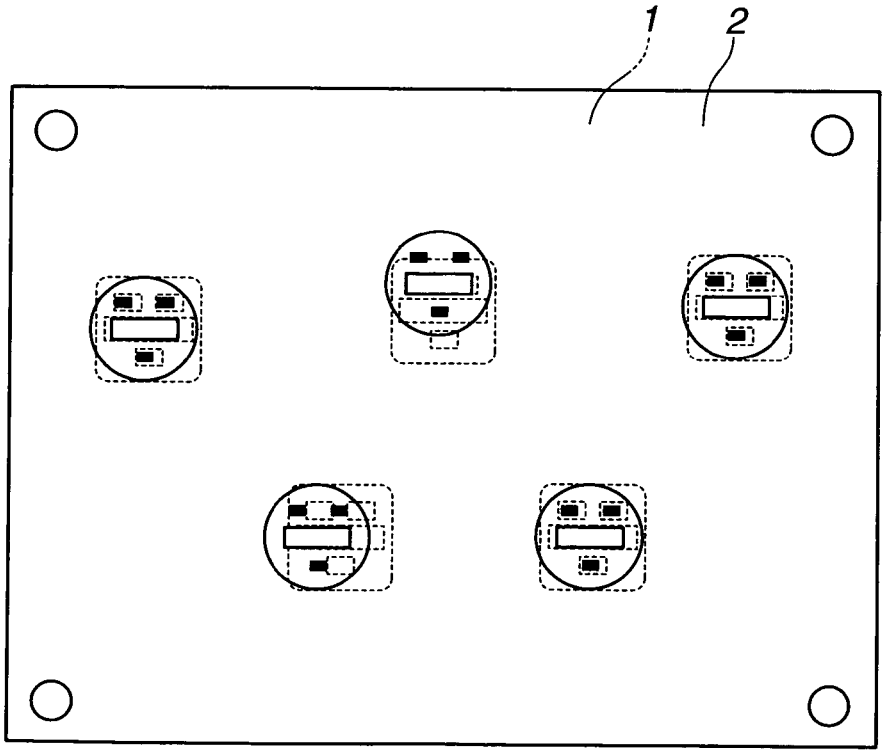
FIG. 19 is a front view of an ECU board and a hydraulic circuit housing, employing a normal fitting-type terminal, when viewed from positive direction of z-axis.

Next, effects of this embodiment will be explained in comparison with the related art. As mentioned above, if the contact-type terminal or connector is used like the connector in JP2002-542107, the contact portion or connecting portion have to be gold plated in order to ensure the electrical connection, then this leads to the increase in cost. On the other hand, when using the fitting-type terminal, the increase in cost can be prevented. Instead, as shown in FIG. 19, in a case where normal fitting-type terminals are merely provided at hydraulic circuit housing 1 and ECU board 2, it is difficult to connect a plurality of male and female connectors at once, due to the errors in size or shape or the like which each member or connector itself has.

However, in the embodiment 1, male terminal 110 and terminal guide 120 project parallel to each other from terminal stage 130 of male connector 100 in a same direction, and terminal stage 130 is installed inside case 140 such that parallel and rotational motions in three dimensional directions of terminal stage 130 are available. By this setting, even in the presence of misalignment or deviation of position between each pair of male and female connectors 100, 200 due to the assembly errors and the errors in size or shape or the like which each member itself has, terminal guide 120 can be inserted into guide insertion hole 220 smoothly by the parallel and rotational motions of terminal stage 130. Then, male terminal 110 can certainly be fitted to female terminal 210.

Further, by terminal stage 130 which is capable of the parallel and rotational motions, even in the presence of deviation of the central axes "L1, L2" of male and female connectors 100, 200 due to the assembly errors and the errors in size or shape or the like which each member itself has, the deviation can be corrected, then all pair of male and female connectors 100, 200 disposed at hydraulic circuit housing 1 and ECU housing 4 (ECU board 2) can be fitted or connected to each other at once. Thus, it is possible to facilitate assembly of connection between terminals (or connectors) without incurring the increase in cost.

In addition to this, terminal stage 130 is capable of the parallel and rotational motions in three dimensional directions. This allows male terminal 110 and terminal guide 120 to move in z-axis direction. Accordingly, although there is a vibration in z-axis direction which puts a load on each member, it is possible to prevent the load by way of movement in z-axis direction of male terminal 110 and terminal guide 120. Breakage of male terminal 110, caused by deterioration with time, can be therefore avoided.

With respect to tapered portion 121 and tapered surface 221, tapered portion 121 is formed at the upper end portion of terminal guide 120, and tapered surface 221 is formed at opening portion 222 of guide insertion hole 220 in this embodiment. By the provision of tapered portion or tapered surface (portion) at at least one of the terminal guide 120 or guide insertion hole 220, terminal stage 130 can easily move parallel to x-y plane. This can reduce a load caused by contact between terminal guide 120 and guide insertion hole 220 during the movement of terminal stage 130 on male connector 100.

Further, with respect to the connection between male and female connectors 100, 200 (or male and female terminals 110, 210), the accurate positioning is first made by fitting or inserting terminal guide 120 of male connector 100 into guide insertion hole 220 of female connector 200 by the parallel motion of terminal stage 130 before the connection. After that, male and female terminals 110, 210 are fitted and connected to each other. Accordingly, a load that is put on male terminal 110 at the connection between male and female connectors 100, 200 can be reduced.

Further, male terminal 110 and terminal guide 120 are formed separately, and male terminal 110 is disposed at the position where male terminal 110 can abut against terminal guide 120 by elastic deformation. As a result, even if the external forces from positive and direction of x-axis are exerted on male terminal 110, male terminal 110 can abut against terminal guide 120 within the elastic deformation, and plastic deformation of male terminal 110 can be prevented. Terminal guide 120 acts as the splint that protects male terminal 110 from the external forces, and it is possible to prevent the plastic deformation of male terminal 110 even in a case where an interference or unintentional contact between male terminal 110 and other members occur.

Furthermore, in this embodiment, the height in z-axis direction of male terminal 110 is set to be lower than that of terminal guide 120. Therefore, at the insertion or fitting of male terminal 110, terminal guide 120 can certainly touch or contact female connector 200 prior to male terminal 110. The load that is put on male terminal 110 at the connection can be further reduced.

Moreover, male terminal 110 is the connection terminal that connects fluid pressure sensor 3 and ECU board 2, fluid pressure sensor 3 is provided at the lower end portion of male connector 100 through seat 150 that supports terminal stage 130 on which male terminal 110 is disposed. By this setting, male terminal 110 can move independently of fluid pressure sensor 3, that is, the movement of male terminal 110 does not exert an influence on fluid pressure sensor 3. Further, pressure pulsation in z-axis direction is absorbed by the movement in z-axis direction of male terminal 110, and then an influence on male connector 100 can be reduced.

Figure 20:
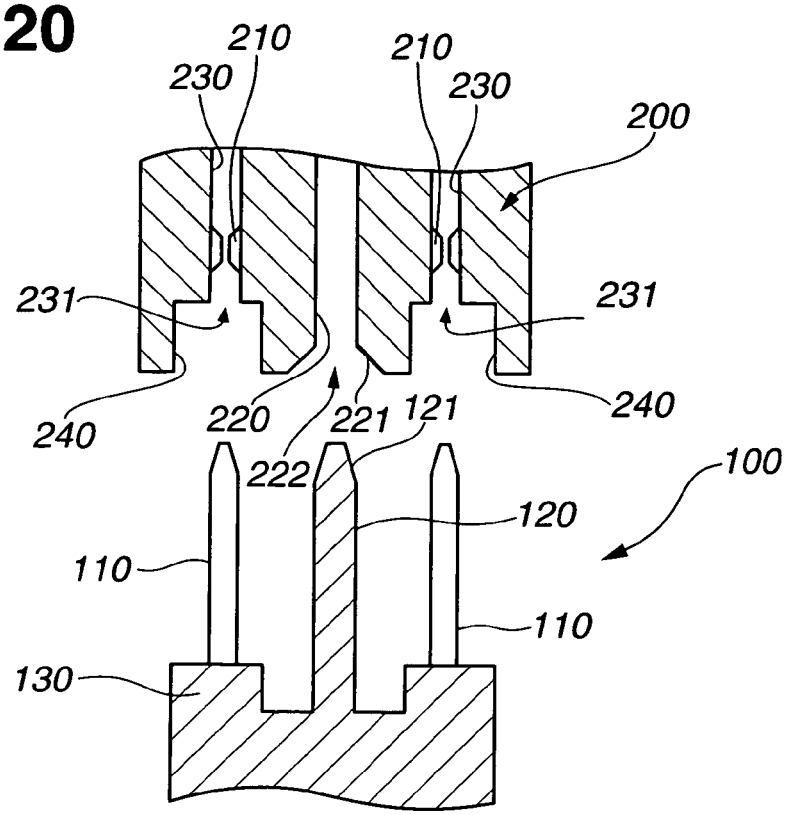
FIG. 20 is an example of modification, in which both heights of the male connector and the terminal guide in z-axis direction are the same, in an embodiment 1-1.

Next, modifications or modified examples will be enumerated below. An embodiment 1-1 will be explained with reference to FIG. 20. As shown in FIG. 20, with respect to male connector 100, the height in z-axis direction of male terminal 110 is set to be equal to that of terminal guide 120. In this case, as for female connector 200, an opening portion (called an opening portion 231) of terminal insertion hole 230 is formed such that position in z-axis direction of opening portion 231 is higher with respect to that of opening portion 222 of guide insertion hole 220. That is, a recessed or depressed portion 240 is formed at a lower or bottom surface of female connector 200 such that terminal insertion hole 230 is opened through recessed portion 240 (or, such that terminal insertion hole 230 is opened at a bottom surface of recessed portion 240). By this setting, even though the both heights of the male terminal 110 and terminal guide 120 are equal, terminal guide 120 can certainly be inserted into guide insertion hole 220 prior to male terminal 110.

Figure 21:
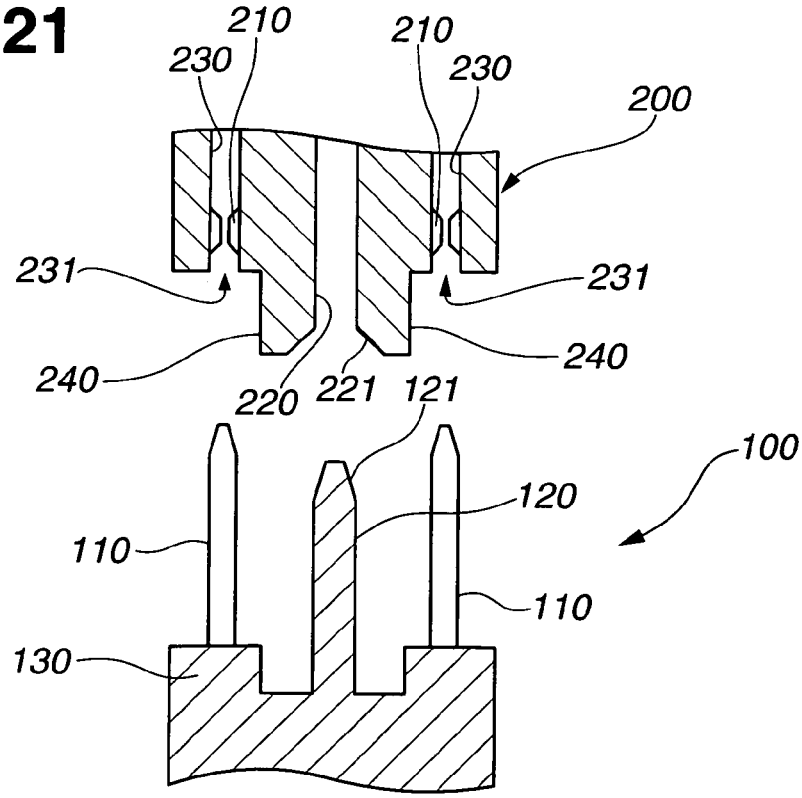
FIG. 21 is an example of modification, in which a height of the male connector in z-axis direction Is higher than that of the terminal guide, in an embodiment 1-2.

An embodiment 1-2 will be explained with reference to FIG. 21. As shown in FIG. 21, the height in z-axis direction of terminal guide 120 is low as compared to the embodiment 1-1. That is, the height in z-axis direction of male terminal 110 is set to be higher than that of terminal guide 120. In this case, opening portion 231 of terminal insertion hole 230 is set to be even higher than that of the embodiment 1-1, and therefore terminal guide 120 can certainly be inserted into guide insertion hole 220 prior to male terminal 110.

Figure 22:
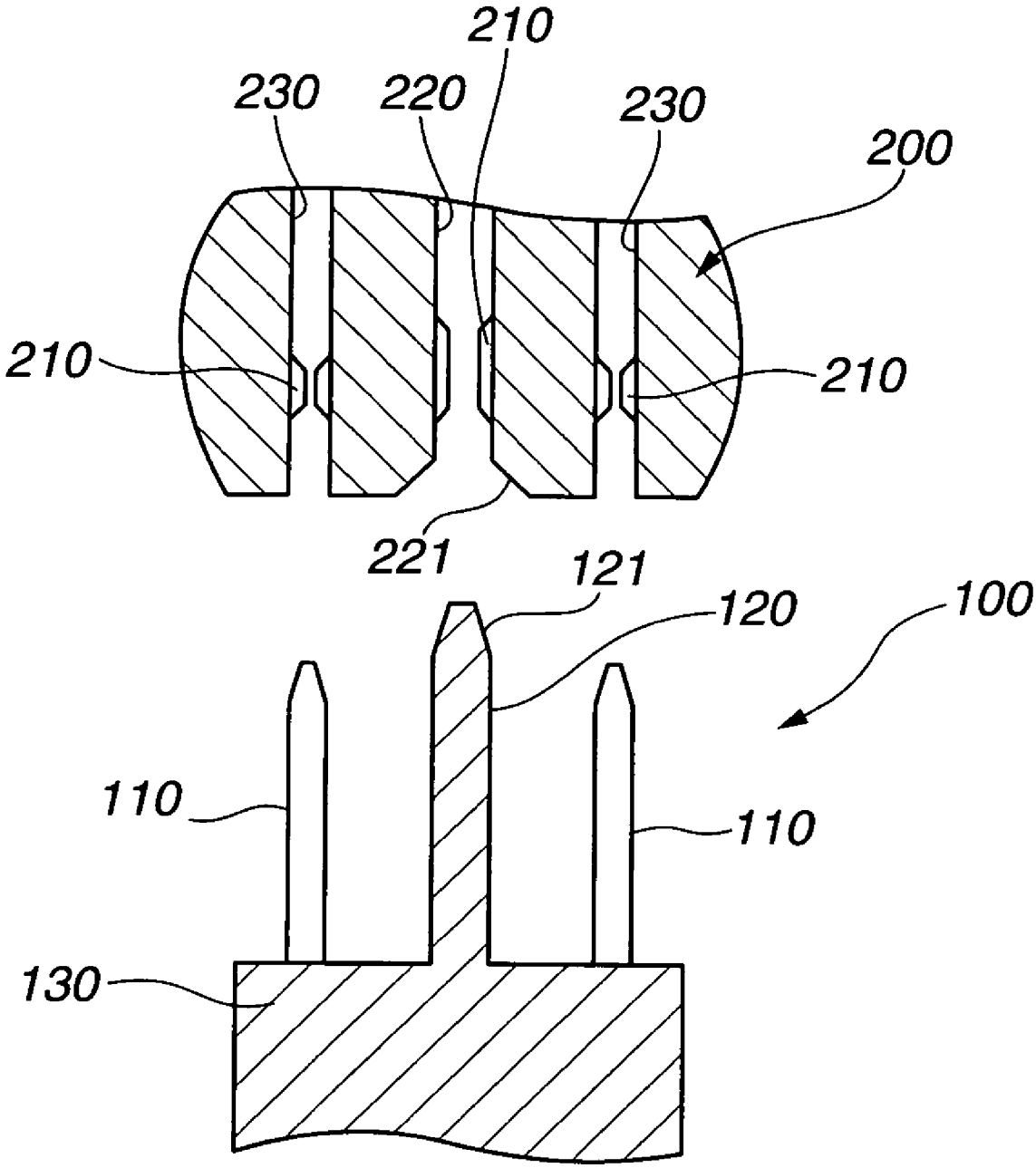
FIG. 22 is an example of modification, in which the terminal guide provided at the male connector side also acts as the terminal, in an embodiment 1-3.

An embodiment 1-3 will be explained with reference to FIG. 22. In the embodiment 1-3, terminal guide 120 of male connector 100 is also used as the terminal (male terminal). That is, terminal guide 120 acts as the terminal guide and the terminal. In this case, terminal guide 120 is formed with conductive member or materials. As for female connector 200, female terminal 210 is provided inside guide insertion hole 220 too.

Figure 23:
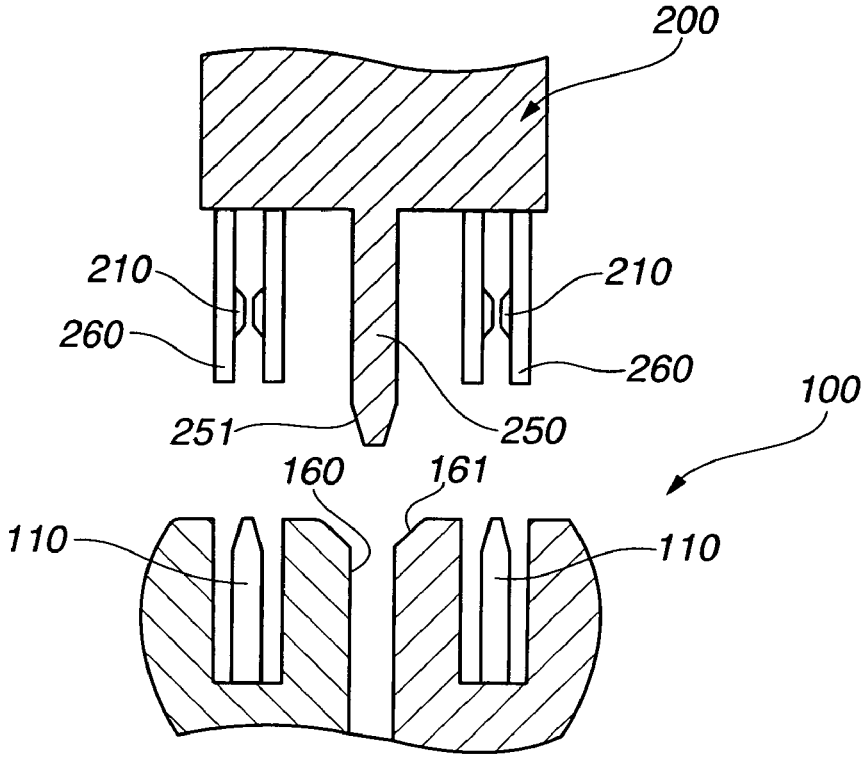
FIG. 23 is an example of modification, in which a terminal guide portion is provided for the female connector, in an embodiment 1-4.

An embodiment 1-4 will be explained with reference to FIG. 23. In the embodiment 1-4, the terminal guide (called a guide 250) is provided for female connector 200. At a lower end portion of guide 250, a tapered portion 251 is formed. In addition, a cylindrical member 260 is formed to hold or retain female terminal 210 such that cylindrical member 260 projects from female connector 200. As for male connector 100, a guide insertion hole 160 is formed at an upper portion of male connector 100 to receive guide 250. Further, a tapered surface 161 is formed at an opening of guide insertion hole 160 so as to guide the guide 250 smoothly. Then, guide 250 is inserted into guide insertion hole 160 smoothly. The positioning is, therefore, achieved before the connection, and male and female terminals 110, 210 can be fitted to each other.

Figure 24:
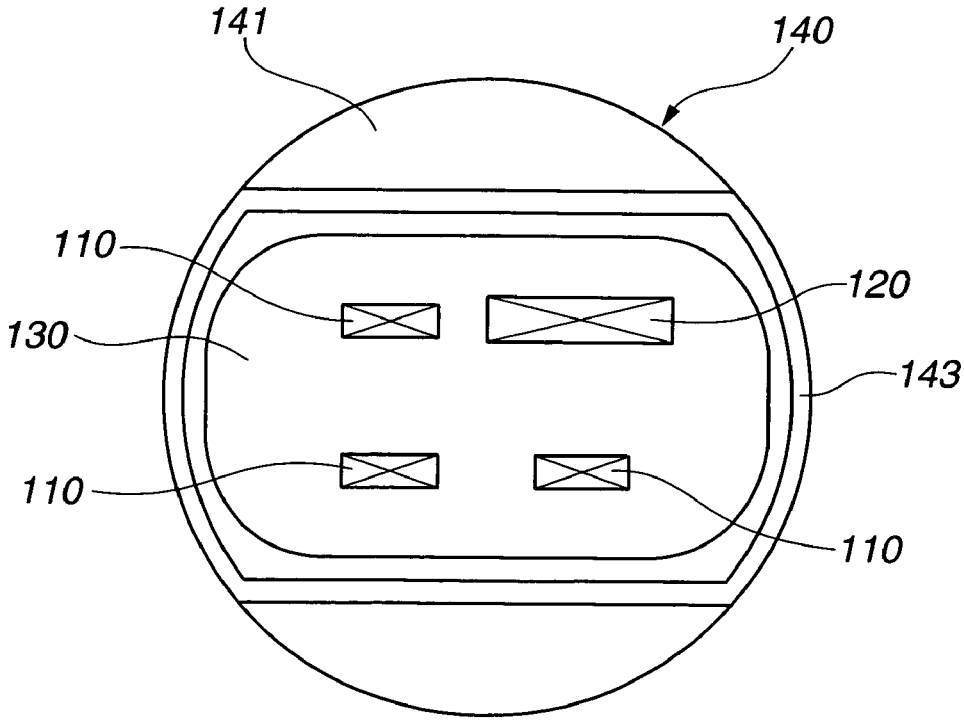
FIG. 24 is an example of modification, in which position of the terminal guide is not center on the terminal stage, in an embodiment 1-5.

An embodiment 1-5 will be explained with reference to FIG. 24. In the embodiment 1-5, terminal guide 120 is provided at terminal stage 130 such that terminal guide 120 is not positioned at a center of terminal stage 130.

In cases of the above embodiments 1-1 to 1-5 as well, the same effects as the embodiment 1 are obtained.

Figure 25:
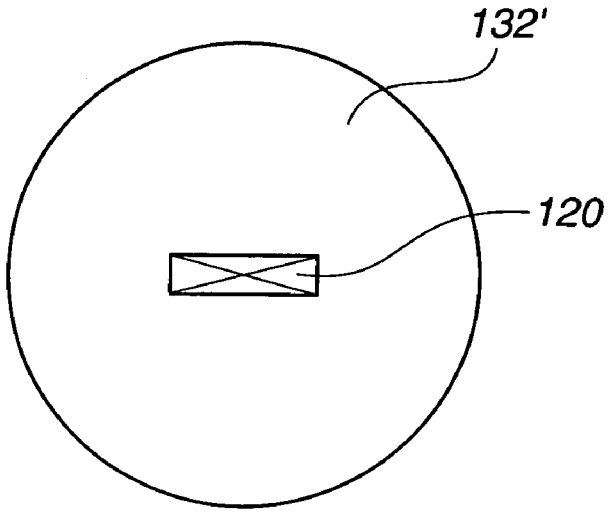
FIG. 25 is a front view of a terminal stage according to the embodiment 2, when viewed from positive direction of z-axis.

Next, an embodiment 2 will be explained with reference to FIG. 25. FIG. 25 is a front view of the terminal stage, when viewed from positive direction of z-axis, and male terminal 110 is omitted. The embodiment 2 is structurally similar to the embodiment 1 except for shape of projecting portion 132. In the embodiment 1, projecting portion 132 is formed into substantially oval or ellipse or oblong figure. On the other hand, in this embodiment 2, the projecting portion (called a projecting portion 132') is substantially round or circular in shape. Since the cross-section of terminal guide 120 is rectangle, terminal guide 120 serves to stop rotation of projecting portion 132'. Therefore, the projecting portion could be substantially circular in shape. In the embodiment 2 also, the same effects as the embodiment 1 are obtained.

Figure 26:
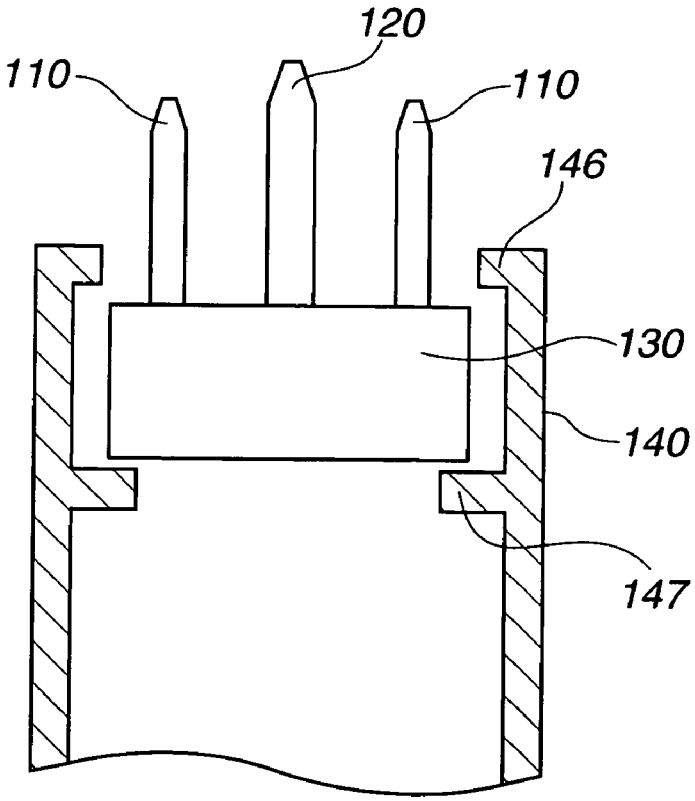
FIG. 26 is a sectional view of a case according to the embodiment 3.

Next, an embodiment 3 will be explained with reference to FIG. 26. The embodiment 3 is structurally similar to the embodiment 1 except for an installation of terminal stage 130 inside case 140. In the embodiment 1, terminal stage 130 is supported by seat 150, and its movement in the negative direction of z-axis is limited by seat 150. While, the movement in the positive direction of z-axis of terminal stage 130 is limited by stepped portion 141 of case 140. On the other hand, in the embodiment 3, retaining portions 146 and 147 are provided inside case 140 at the upper end portion of case 140 in order to install terminal stage 130 between retaining portions 146 and 147. Retaining portions 146 and 147 extend or project from an inside surface of case 140 in a radially inward direction, and then are formed in a circumferential direction inside case 140. Terminal stage 130 is installed between retaining portions 146 and 147 inside case 140 with a certain or predetermined space or clearance. That is, retaining portions 146 and 147 do not completely limit the movement of terminal stage 130, terminal stage 130 is installed so that terminal stage 130 is capable of the parallel and rotational motions in three dimensional directions.

With respect to the clearance which allows the movement of terminal stage 130, an amount of clearance (or an amount of the movement in three dimensional directions of terminal stage 130) is set to substantially the amount of position deviation between male and female connectors 100, 200 caused by the errors in size or shape or the like which each member itself has. By this setting of the clearance, it is possible to improve the workability of assembly of male and female connectors 100, 200. As explained above, in the embodiment 3 as well, the same effects as the embodiment 1 are obtained.

Figure 27:
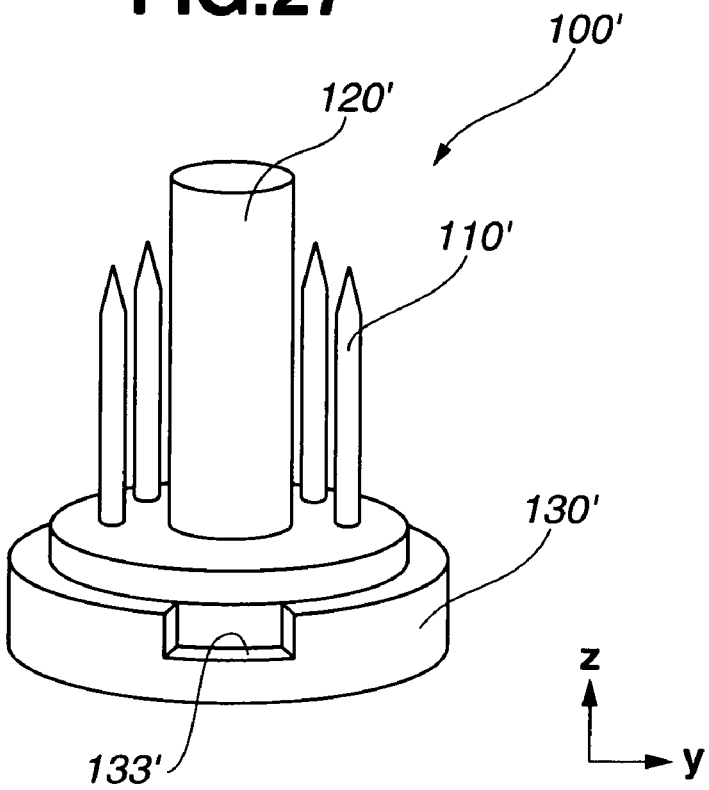
FIG. 27 is a perspective view of a male connector according to an embodiment 4.
Figure 28:
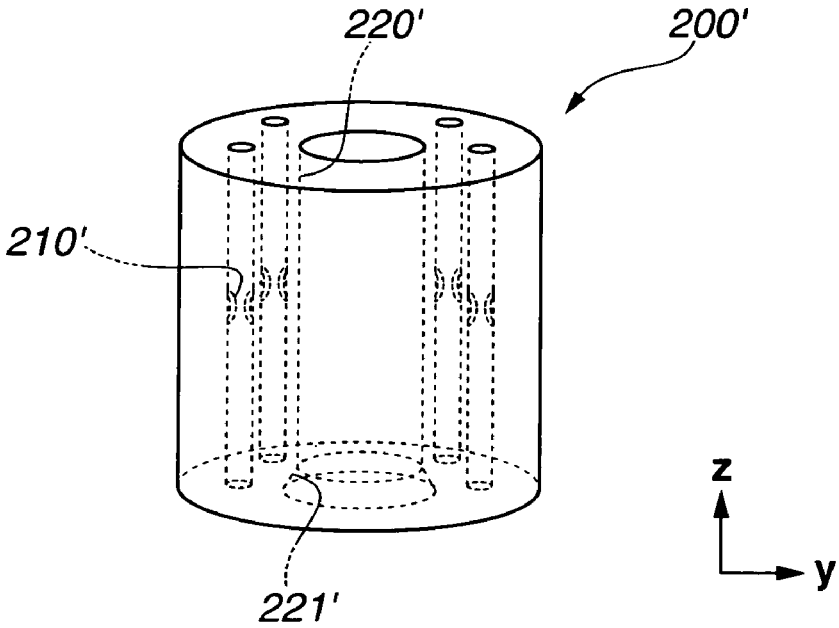
FIG. 28 is a perspective view of a female connector according to the embodiment 4.

Next, an embodiment 4 will be explained with reference to FIGS. 27 to 30. The embodiment 4 is structurally similar to the embodiment 1 except for the terminal guide and so on. FIG. 27 shows a perspective view of a male connector 100' (only a male terminal 110', a guide 120' and a terminal stage 130' are shown). FIG. 28 shows a perspective view of a female connector 200'. In both FIGS. 27, 28, the direction of extension of guide 120' from terminal stage 130' and the direction of insertion of guide 120' into a guide insertion hole 220', are the positive direction of z-axis. The direction parallel to the drawings is y-axis, the direction normal to the drawings is x-axis.

In the embodiment 4, guide 120' of male connector 100' is formed into cylindrical shape. Male terminal 110' is also formed into cylindrical shape. Further, male terminal 110' tapers to a point at the top. At periphery of terminal stage

130', as shown in FIG. 27, a rotation stopper receiving portion 133' is provided as an anti-rotation mechanism. This rotation stopper receiving portion 133' is formed by cutting away circumferentially-opposed arcs of outer periphery of terminal stage 130' from the positive direction of z-axis such that rotation stopper receiving portion 133' is recessed radially inward and downward.

Although the detail of the anti-rotation mechanism will be explained later, the rotation of a certain rotation amount or more of terminal stage 130' is limited by means of rotation stopper receiving portion 133' and a rotation stopper portion 141' (see FIGS. 29, 30) that is provided for a case 140'. Here, in this embodiment, two rotation stopper receiving portions 133' are provided at circumferentially-opposed positions of outer periphery of terminal stage 130' along x-axis direction. However, the positions are not limited to these positions. Further, the number of rotation stopper receiving portion 133' is not limited to 2. However, at least one rotation stopper receiving portion 133' must be provided in order to limit the rotation of terminal stage 130'.

Regarding female connector 200', as shown in FIG. 28, a female terminal 210' and guide insertion hole 220' that is capable of receiving guide 120' are provided for female connector 200'. At an opening portion in the negative direction of z-axis of guide insertion hole 220', a tapered surface 221' is formed, and this facilitates the insertion of guide 120' of male connector 100' into guide insertion hole 220' in the same manner as the embodiment 1.

Figure 29:
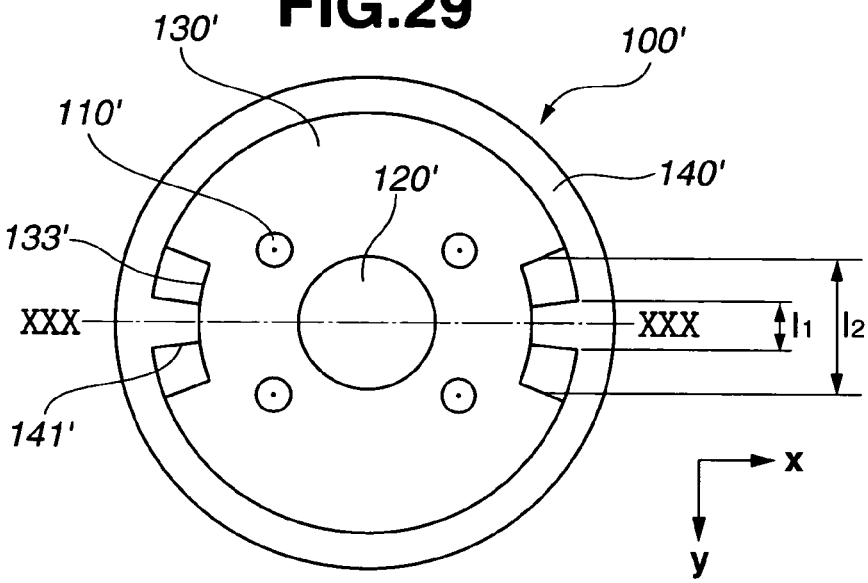
FIG. 29 is a front view of the male connector according to the embodiment 4, when viewed from positive direction of z-axis.
Figure 30:
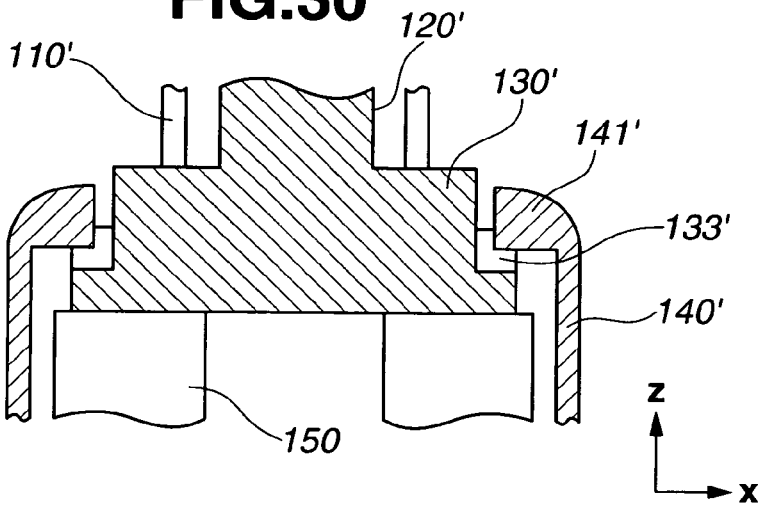
FIG. 30 is a sectional view of the male connector according to the embodiment 4, cut by a line XXX-XXX of FIG. 29.

Regarding the anti-rotation mechanism, it will be explain below. FIG. 29 shows a front view of male connector 100', when viewed from positive direction of z-axis. FIG. 30 is a sectional view of male connector 100', cut by a line XXX-XXX of FIG. 29. The line XXX-XXX is parallel to x-axis. As shown in FIGS. 29, 30, rotation stopper portion 141' is formed at a top end portion of case 140' such that rotation stopper portion 141' projects in the radially inward direction at a cross-position between the line XXX-XXX and an outer periphery of case 140'. Further, a width "I1" of rotation stopper portion 141' is set to be smaller than a width "I2" of rotation stopper receiving portion 133' of terminal stage 130' (namely, I1<I2). By the relation of "I1<I2", terminal stage 130' can rotate or turn only within a certain allowable range.

With respect to an assembly of terminal stage 130' and case 140', terminal stage 130' is inserted into case 140' from the negative direction of z-axis such that rotation stopper portion 141' is fitted to or engages with rotation stopper receiving portion 133' of terminal stage 130', and then terminal stage 130' is installed inside case 140'. As described above, since rotation stopper receiving portion 133' is recessed radially inward and downward, by the engagement between rotation stopper portion 141' and rotation stopper receiving portion 133', rotation stopper portion 141' limits the movement in the positive direction of z-axis of terminal stage 130' to within a predetermined allowable limits (that is, rotation stopper portion 141' acts as a limiting or limitation portion that limits the movement in the positive direction of z-axis of terminal stage 130' to within the predetermined allowable limits). Namely, that terminal stage 130' can move in the positive direction of z-axis only within the predetermined allowable limits. Additionally, by this engagement (or, by the anti-rotation mechanism), rotation stopper portion 141' limits the rotational movement or motion of terminal stage 130' to within the certain allowable range.

On the other hand, regarding the movement in the negative direction of z-axis of terminal stage 130', in the same manner as the embodiment 1, since terminal stage 130' is supported by seat 150 that is provided inside case 140', the movement in the negative direction of z-axis of terminal stage 130' is limited by this seat 150. That is to say, the movement in the positive direction of z-axis of terminal stage 130' is limited to within the predetermined allowable limits by rotation stopper portion 141', and the movement in the negative direction of z-axis is limited by seat 150. In this way, terminal stage 130' is installed and supported between seat 150 and rotation stopper portion 141' inside case 140' such that terminal stage 130' is movable and rotatable with respect to case 140' in the three dimensional directions within the predetermined allowable range.

By the above setting, that is by the parallel and rotational motions in three dimensional directions of terminal stage 130', in the embodiment 4 also, the position deviation between male and female connectors 100', 200' caused by the errors in size or shape or the like which each member itself has can be absorbed. And thus, it is possible to improve the workability of assembly of male and female connectors 100', 200', and the same effects as the embodiment 1 are obtained.

Figure 31:
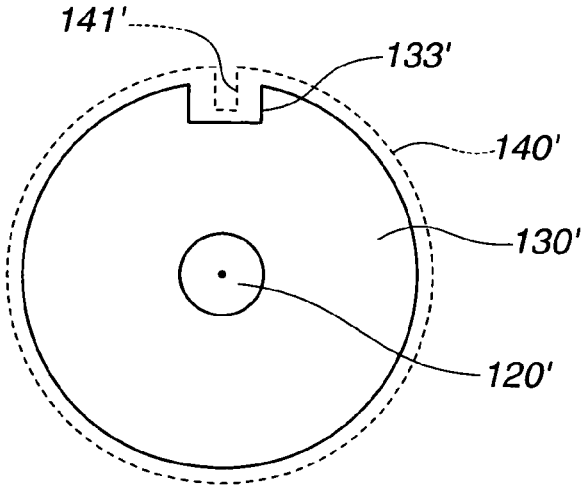
FIG. 31 is a front view of a terminal stage according to the embodiment 4-1, when viewed from positive direction of z-axis.

Next, modifications or modified examples of the embodiment 4 will be shown below. An embodiment 4-1 will be explained with reference to FIG. 31. FIG. 31 is a front view of a terminal stage 130', when viewed from positive direction of z-axis. In this embodiment, a top end portion of guide 120' is formed into conical shape, and only one rotation stopper receiving portion 133' and one rotation stopper portion 141' are provided as the anti-rotation mechanism.

Next, an embodiment 5 will be explained with reference to FIGS. 32 to 35. The embodiment 5 is structurally similar to the embodiment 1 except for the male terminal and terminal guide. In the embodiment 1, male terminal 110 and terminal guide 120 are formed separately. However, in the embodiment 5, a male terminal 110" is embedded or implanted in a guide 120" (in a surface of guide 120"), then male terminal 110" and guide 120" (or guide portion) are integral with each other.

Figure 32:
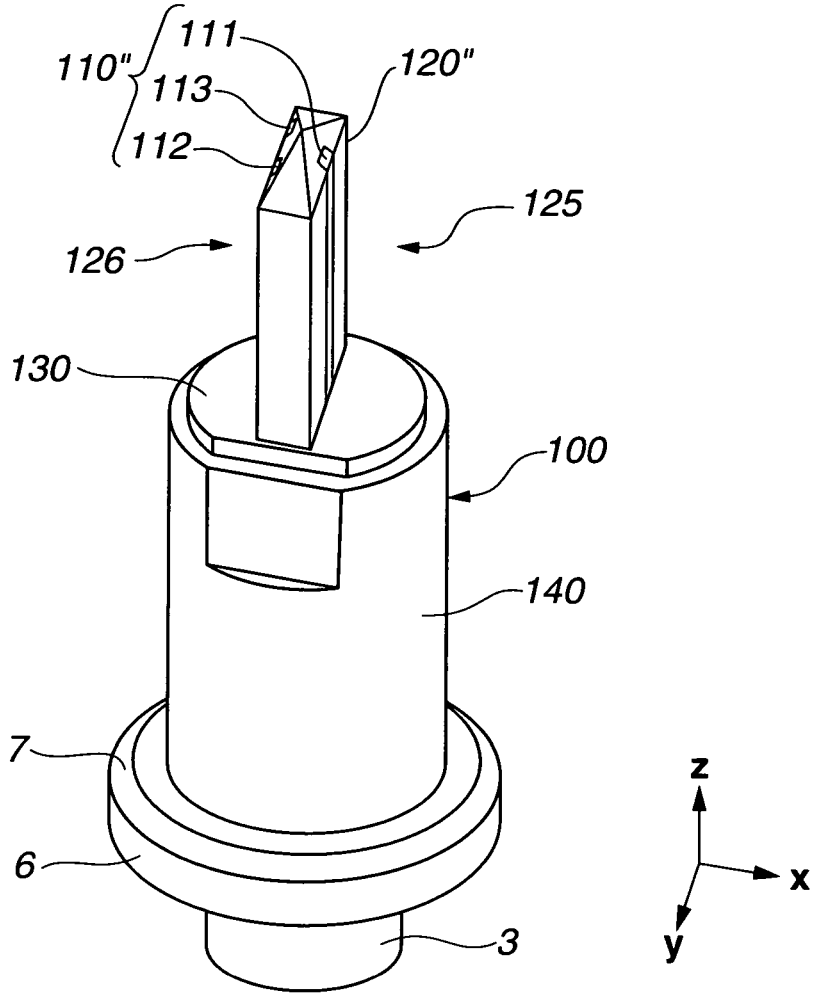
FIG. 32 is a perspective view of a male connector according to an embodiment 5.
Figure 33:
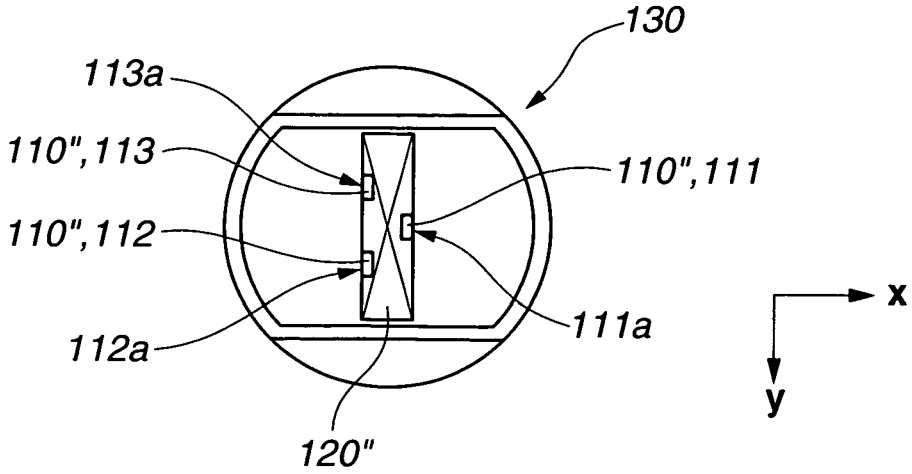
FIG. 33 is a front view of a terminal stage according to the embodiment 5, when viewed from positive direction of z-axis.
Figure 34:
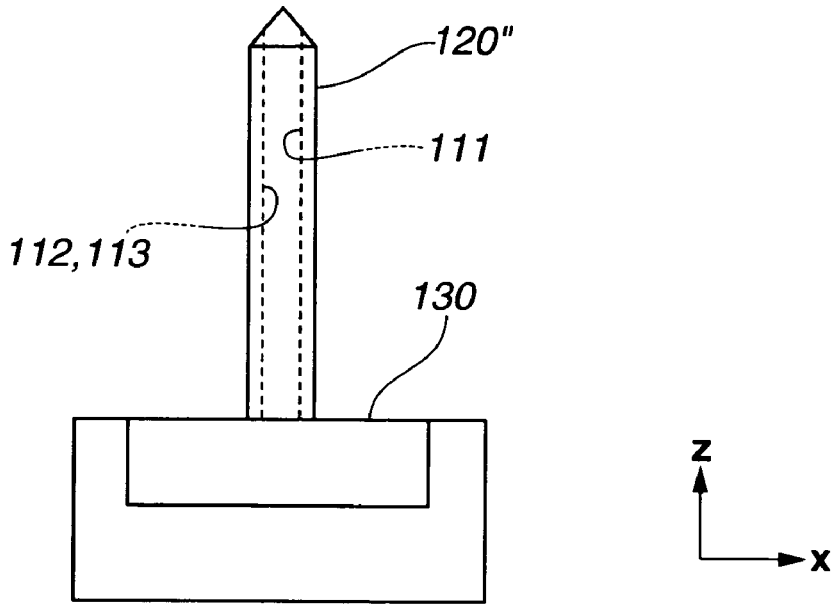
FIG. 34 is a front view of the terminal stage according to the embodiment 5, when viewed from positive direction of y-axis.

FIG. 32 is a perspective view of a male connector 100. FIG. 33 is a front view of a terminal stage 130, when viewed from positive direction of z-axis. FIG. 34 is a front view of terminal stage 130, when viewed from positive direction of y-axis. A first terminal 111 of a male terminal 110" is embedded in a positive direction side 125 in x-axis direction of a guide 120" such that an x-axis positive direction side face 111*a* of first terminal 111 is exposed or bare. Likewise, a second terminal 112 and a third terminal 113 of male terminal 110" are embedded in a negative direction side 126 in x-axis direction of guide 120" such that x-axis negative direction side faces 112*a* and 113*a* are exposed or bare.

Figure 35:
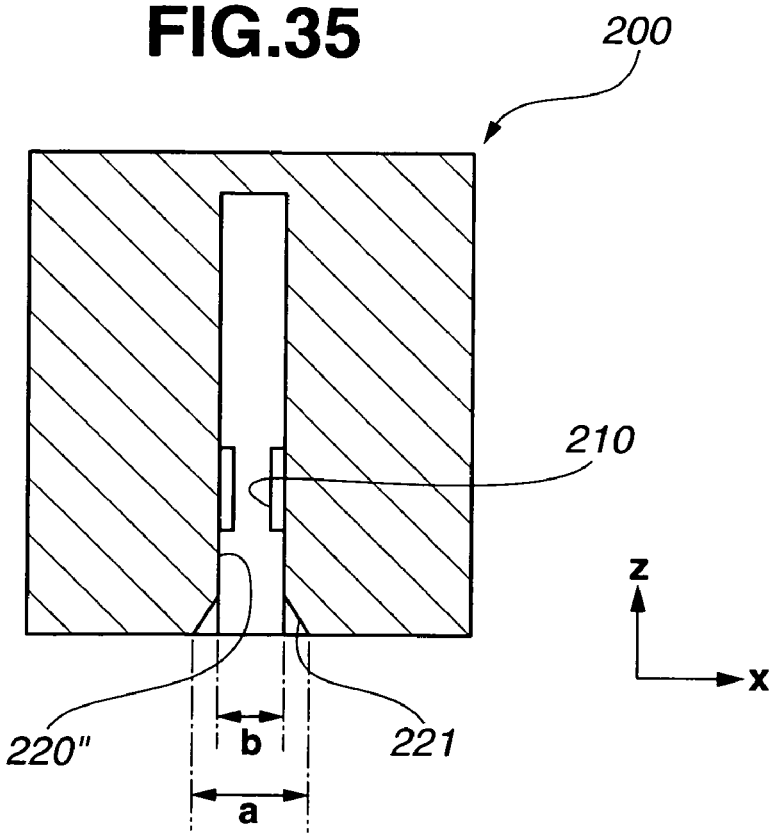
FIG. 35 is a sectional view of a female connector according to the embodiment 5.

FIG. 35 is a sectional view of a female connector 200. Since male terminal 110" and guide 120" are integral with each other, a female terminal 210 is provided inside a guide insertion hole 220" of female connector 200.

In the embodiment 5 also, terminal stage 130 is installed inside case 140 such that the parallel and rotational motions in the three dimensional directions of terminal stage 130 are available inside case 140, then the same effects as the embodiment 1 are obtained. In addition, since male terminal 110" is embedded in guide 120", an interference or unintentional contact between male terminal 110" and other members do not occur at the connection or assembly. Male terminal 110" is therefore able to be protected considerably.

This application is based on a prior Japanese Patent Application No. 2005-227546 filed on Aug. 5, 2005. The entire contents of this Japanese Patent Application No. 2005-227546 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A connection terminal comprising:

a housing;

a case fixed to the housing;

a terminal stage installed inside the case and having a first terminal and a guide portion, the first terminal and the guide portion projecting parallel to each other from one end of the terminal stage in the same direction;

a connected member facing the case and having a second terminal to which the first terminal is fitted and connected for establishment of electrical connection, and a guide insertion hole to which the guide portion is fitted;

the terminal stage being movable in three dimensional directions while being installed inside the case; and the first and second terminals being fitted to each other after the guide portion is fitted to the guide insertion hole.

2. The connection terminal as claimed in claim 1, wherein:

the first terminal and the guide portion are separately provided at the terminal stage, and the second terminal and the guide insertion hole are separately provided at the connected member.

3. A connection terminal assembly comprising:

a first housing;

a plurality of first assemblies disposed at the first housing, each of which has a case fixed to the first housing, a terminal stage installed inside the case, a first terminal, and a guide portion, the first terminal and the guide portion projecting parallel to each other from one end of the terminal stage in the same direction;

a second housing including a connected member that faces the case;

a plurality of second assemblies as many as the first assemblies, fixed at positions corresponding to the first assemblies on the connected member to combine with the first assemblies, each of the second assemblies having a second terminal to which the first terminal is fitted and connected for establishment of electrical connection, and a guide insertion hole to which the guide portion is fitted; and the terminal stage being movable inside the case in three dimensional directions when combining the first and second assemblies.

4. The connection terminal assembly as claimed in claim 3, wherein:

the first and second terminals are fitted to each other after the guide portion is fitted to the guide insertion hole.

5. The connection terminal as claimed in claim 1, wherein:

the case has a rotation stopper portion that limits rotation of the terminal stage; and the rotation stopper portion limits a movement on a plane normal to the direction of connection between the first and second terminals of the terminal stage to within predetermined allowable limits.

6. The connection terminal as claimed in claim 2, wherein:

the case has a rotation stopper portion that limits rotation of the terminal stage; and the rotation stopper portion limits a movement on a plane normal to the direction of connection between the first and second terminals of the terminal stage to within predetermined allowable limits.

7. The connection terminal assembly as claimed in claim 3, wherein:

the case has a rotation stopper portion that limits rotation of the terminal stage; and the rotation stopper portion limits a movement on a plane normal to the direction of connection between the first and second terminals of the terminal stage to within predetermined allowable limits.

8. The connection terminal as claimed in claim 5, wherein:

the case further has a limiting portion that limits a movement in a terminal stage installation direction of the terminal stage; and the limiting portion limits a movement in the direction of connection between the first and second terminals of the terminal stage to within predetermined allowable limits.

9. The connection terminal as claimed in claim 6, wherein:

the case further has a limiting portion that limits a movement in a terminal stage installation direction of the terminal stage; and the limiting portion limits a movement in the direction of connection between the first and second terminals of the terminal stage to within predetermined allowable limits.

10. The connection terminal assembly as claimed in claim 7, wherein:

the case further has a limiting portion that limits a movement in a terminal stage installation direction of the terminal stage; and the limiting portion limits a movement in the direction of connection between the first and second terminals of the terminal stage to within predetermined allowable limits.

11. The connection terminal as claimed in claim 2, wherein:

at least one of a top end portion of the guide portion or an opening portion of the guide insertion hole is formed into a tapered shape.

12. The connection terminal as claimed in claim 2, wherein:

a top end portion of the guide portion is positioned higher than a top end portion of the first terminal.

13. The connection terminal as claimed in claim 2, wherein:

the second terminal is provided inside a terminal insertion hole that receives the first terminal; and an opening portion of the terminal insertion hole is positioned higher than an opening portion of the guide insertion hole.

14. The connection terminal as claimed in claim 1, further comprising:

a seat installed inside the case for supporting the terminal stage, the seat limiting a downward movement in the direction of connection between the first and second terminals of the terminal stage;

wherein:

the first and second terminals are terminals that transmit a signal of a fluid pressure sensor; and the fluid pressure sensor is provided at the opposite side to the terminal stage via the seat.

15. The connection terminal as claimed in claim 2, wherein:

the first terminal is disposed at a position where the first terminal can abut against the guide portion by elastic deformation.

16. The connection terminal as claimed in claim 9, wherein:

at least one of a top end portion of the guide portion or an opening portion of the guide insertion hole is formed into a tapered shape.

17. The connection terminal as claimed in claim 8, wherein:

at least one of a top end portion of the guide portion or an opening portion of the guide insertion hole is formed into a tapered shape.

18. The connection terminal assembly as claimed in claim 10, wherein:

at least one of a top end portion of the guide portion or an opening portion of the guide insertion hole is formed into a tapered shape.

19. The connection terminal as claimed in claim 16, wherein:

a top end portion of the guide portion is positioned higher than a top end portion of the first terminal.

20. A method for assembling a connection terminal comprising a first housing, a plurality of first assemblies disposed at the first housing, each of which has a case fixed to the first housing, a terminal stage installed inside the case, a first terminal, and a guide portion, the first terminal and the guide portion projecting parallel to each other from one end of the terminal stage in the same direction, a second housing including a connected member that faces the case, a plurality of second assemblies as many as the first assemblies, fixed at positions corresponding to the first assemblies on the connected member to combine with the first assemblies, each of the second assemblies having a second terminal to which the first terminal is fitted and connected for establishment of electrical connection, and a guide insertion hole to which the guide portion is fitted, and the terminal stage being movable inside the case in three dimensional directions when combining the first and second assemblies, the method comprising:

fitting the guide portion into the guide insertion hole;

guiding the first terminal to a position corresponding to the second terminal by the fit of the guide portion into the guide insertion hole; and fitting the first terminal to the second terminal after guiding the first terminal.

* * * * *